US012146270B2

(12) United States Patent
Bokenkamp et al.

(10) Patent No.: US 12,146,270 B2
(45) Date of Patent: Nov. 19, 2024

(54) RAIL TIE PLATE DISTRIBUTION SYSTEM

(71) Applicant: UNION PACIFIC RAILROAD COMPANY, Omaha, NE (US)

(72) Inventors: Andrew Bokenkamp, Omaha, NE (US); Jake Wagner, Omaha, NE (US); Hans Iwand, Omaha, NE (US)

(73) Assignee: UNION PACIFIC RAILROAD COMPANY, Omaha, NE (US)

( * ) Notice: Subject to any disclaimer, the term of this patent is extended or adjusted under 35 U.S.C. 154(b) by 934 days.

(21) Appl. No.: 17/255,994

(22) PCT Filed: Jun. 26, 2019

(86) PCT No.: PCT/US2019/039220
§ 371 (c)(1),
(2) Date: Dec. 23, 2020

(87) PCT Pub. No.: WO2020/006066
PCT Pub. Date: Jan. 2, 2020

(65) Prior Publication Data

US 2021/0222374 A1 Jul. 22, 2021

Related U.S. Application Data

(60) Provisional application No. 62/689,939, filed on Jun. 26, 2018.

(51) Int. Cl.
*E01B 29/32* (2006.01)

(52) U.S. Cl.
CPC ..... *E01B 29/32* (2013.01)

(58) Field of Classification Search
CPC ..... E01B 29/32; E01B 29/24
USPC ..... 104/16
See application file for complete search history.

(56) References Cited

U.S. PATENT DOCUMENTS

| | | | | |
|---|---|---|---|---|
| 3,943,858 | A * | 3/1976 | Dieringer | E01B 29/24 104/17.1 |
| 4,280,613 | A | 7/1981 | Stewart | |
| 4,478,152 | A * | 10/1984 | Holley | E01B 29/24 104/279 |
| 4,974,518 | A * | 12/1990 | Cotic | E01B 29/32 198/395 |
| 6,807,909 | B1 | 10/2004 | Coots | |
| 8,220,397 | B2 * | 7/2012 | Sperling | E01B 29/32 104/16 |
| 9,156,623 | B1 * | 10/2015 | Buzdum | E01B 29/32 |
| 10,077,532 | B2 * | 9/2018 | Irion | E01B 29/32 |
| 11,015,298 | B2 * | 5/2021 | Sperling | E01B 29/32 |
| 11,982,057 | B1 * | 5/2024 | Sperling | B65G 47/04 |
| 2009/0133598 | A1 | 5/2009 | Coots, Jr. | |
| 2011/0100248 | A1 * | 5/2011 | Buckley | E01B 29/32 104/16 |

(Continued)

OTHER PUBLICATIONS

International Search Report and Written Opinion for PCT/US2019/039220 mailed on Oct. 17, 2019.

*Primary Examiner* — Scott A Browne
(74) *Attorney, Agent, or Firm* — Kutak Rock LLP

(57) ABSTRACT

A rail tie plate distribution system is disclosed. The system includes a hopper for holding a quantity of tie plates. A plurality of stations are provided and are configured to arrange the tie plates into an orientation for placement on railroad ties. A distributor is provided for depositing the tie plates on railroad ties as the system advances along a track.

14 Claims, 22 Drawing Sheets

(56) References Cited

U.S. PATENT DOCUMENTS

| | | | | |
|---|---|---|---|---|
| 2011/0308058 | A1* | 12/2011 | Sperling | E01B 29/32<br>104/2 |
| 2013/0247794 | A1 | 9/2013 | Coots | |
| 2020/0131713 | A1* | 4/2020 | Sperling | E01B 29/10 |
| 2020/0131715 | A1* | 4/2020 | Sperling | E01B 29/32 |

* cited by examiner

RAIL TIE PLATE DISTRIBUTION SYSTEM

CROSS REFERENCE TO RELATED APPLICATIONS

This application is a US national stage filing under 35 USC § 371 of international patent application number PCT/US2019/039220 filed on Jun. 26, 2019, which claims the benefit of U.S. Provisional Application No. 62/689,939, filed Jun. 26, 2018, each of which is incorporated herein by reference in its entirety.

BACKGROUND

On modern railroad tracks, rails that run the direction of train travel are placed on top of ties which extend generally perpendicular to the set of rails. To couple rails to the ties, tie plates are used. The plates are generally coupled to the tie by fasteners of various types and include means for securing to a section of rail. A typical tie plate that may be used in accordance with the invention disclosed herein is the VICTOR plates made by PANDROL USA. Such tie plates include a deformable projection that, in a first position, can receive a rail. With a rail placed on a tie plate, and the tie plate secured to the tie, the projection may be deformed into a second position that secures the rail.

For efficient track laying operations, tie plates are prepositioned on ties. It is important that the tie plates be placed accurately relative to the planned position of the rail. Misplaced tie plates may misalign the rail resulting in irregular motions of passing rail cars which can increase wear rates on rail car, locomotive, and track components while also adversely impacting fuel efficiency.

Accurate placement of tie plates has typically been accomplished by human operators. Tie plates may be roughly positioned by a placement machine which is followed by one or more human operators who adjust the position of the tie plates.

Accordingly, there is a need for a system for efficiently and accurately placing tie plates on ties.

DRAWINGS

A particular description of the invention will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 1 depicts a tie plate laying system including a hopper machine 110, a handling machine 130, and a plate placer rig 190;

Figure 4:
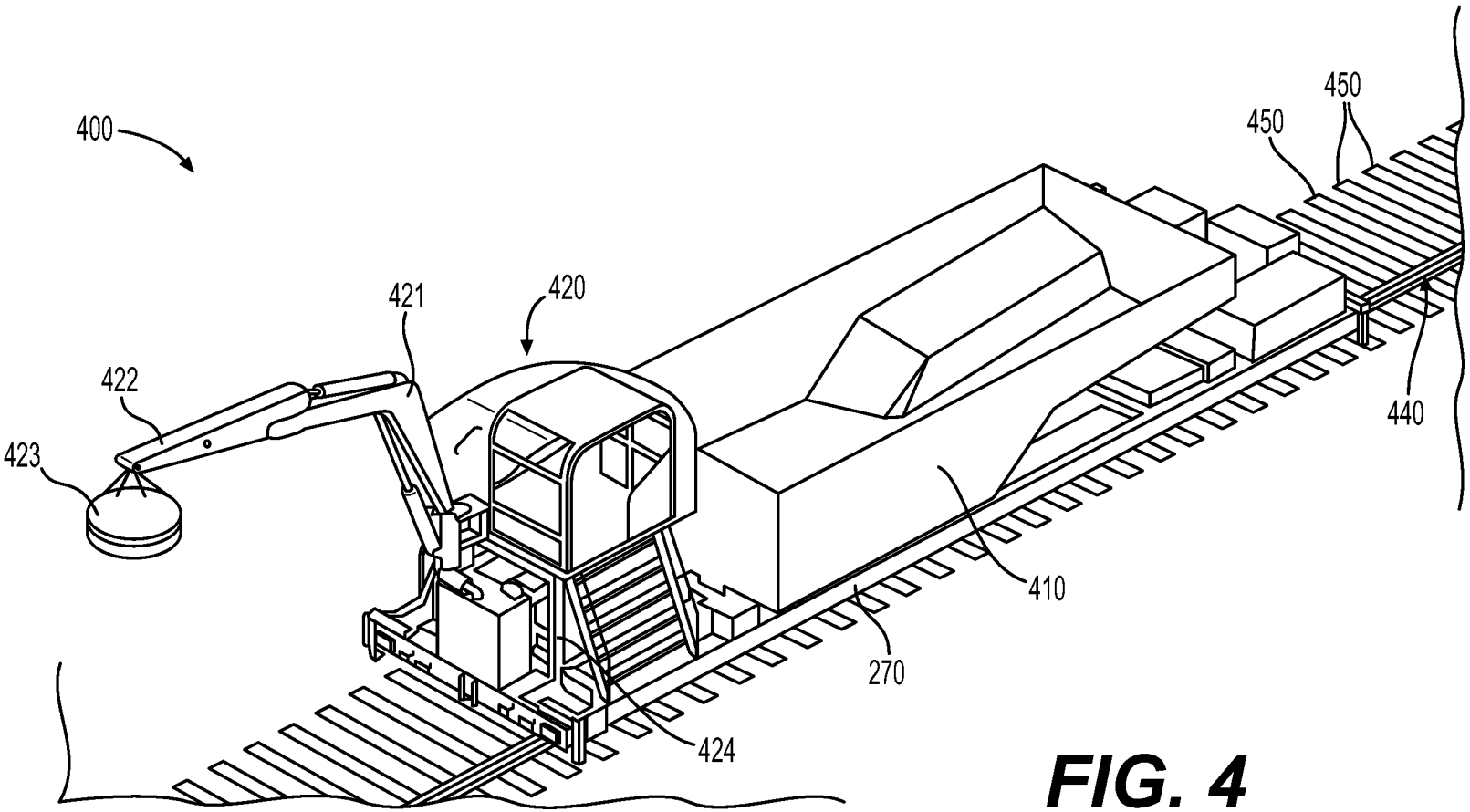
Figure 5:
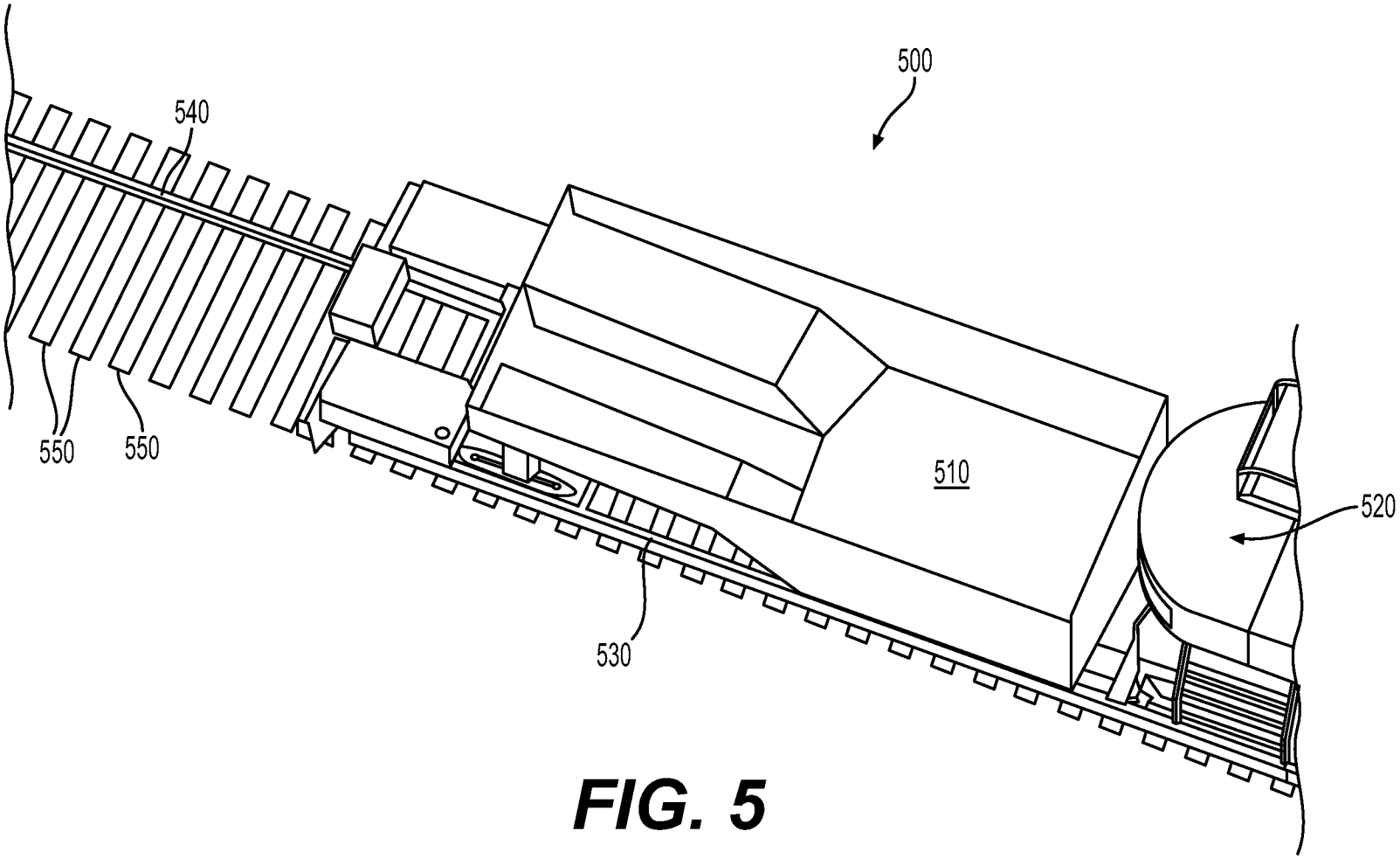
Figure 6:
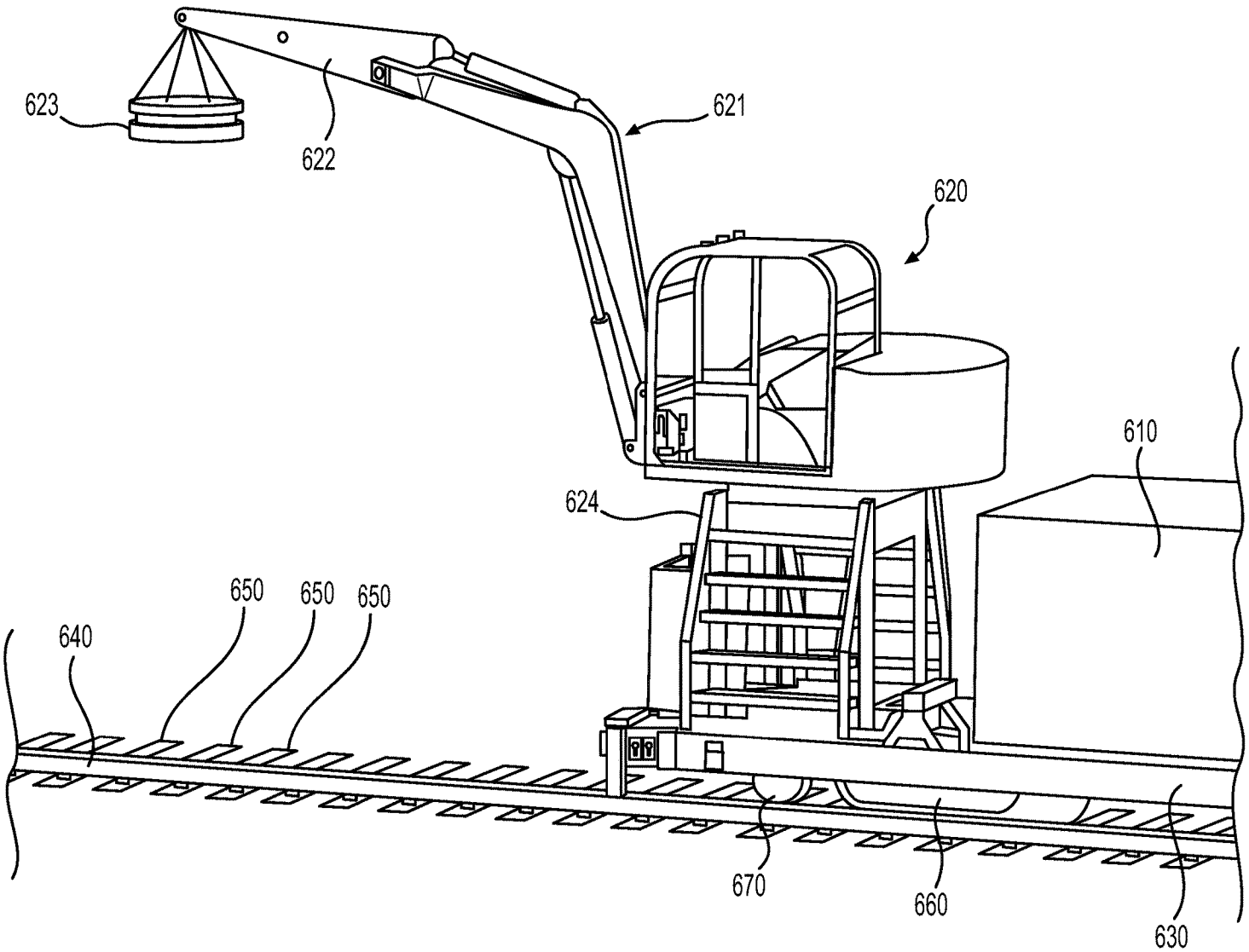
Figure 7:
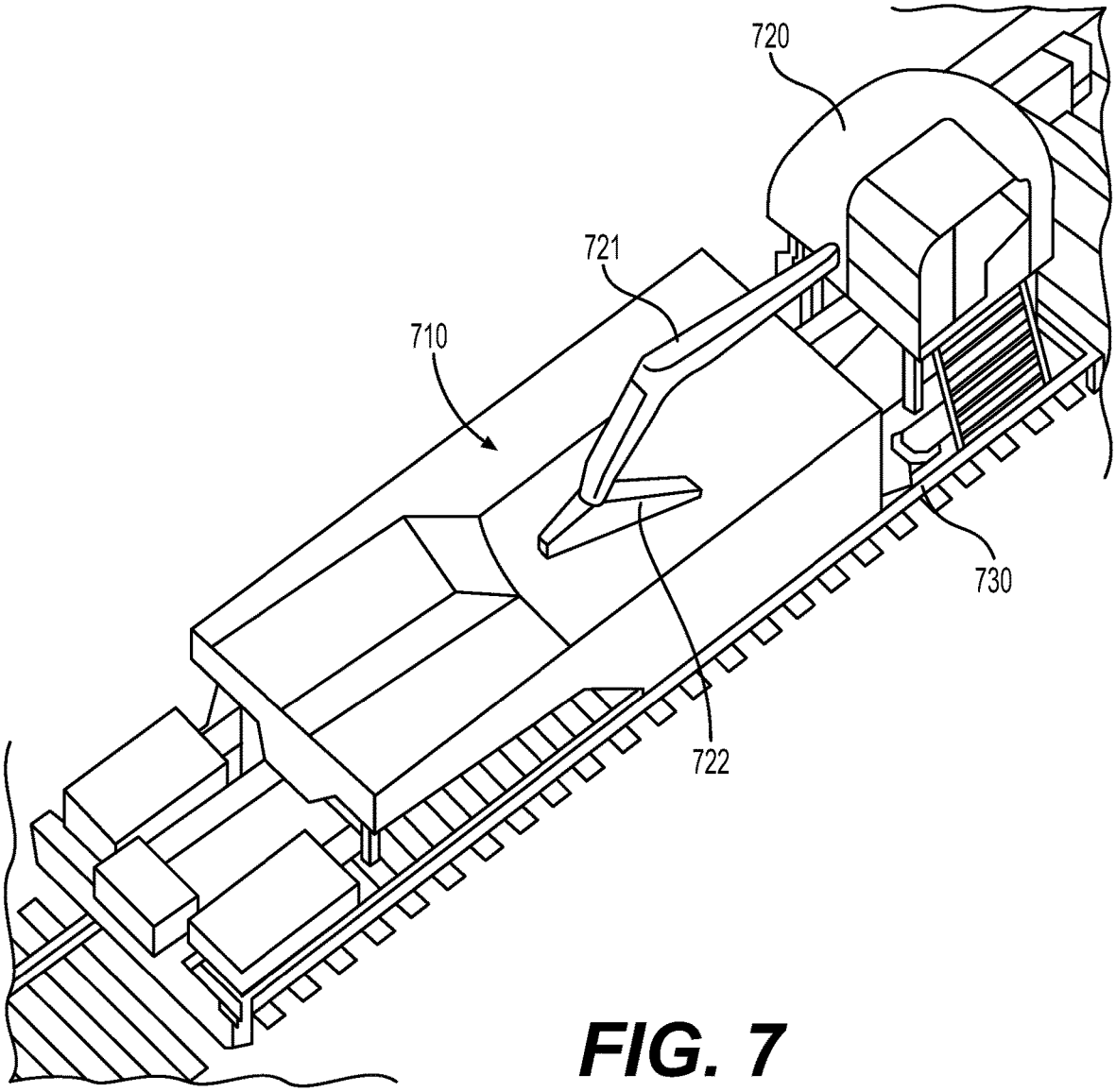
Figure 8:
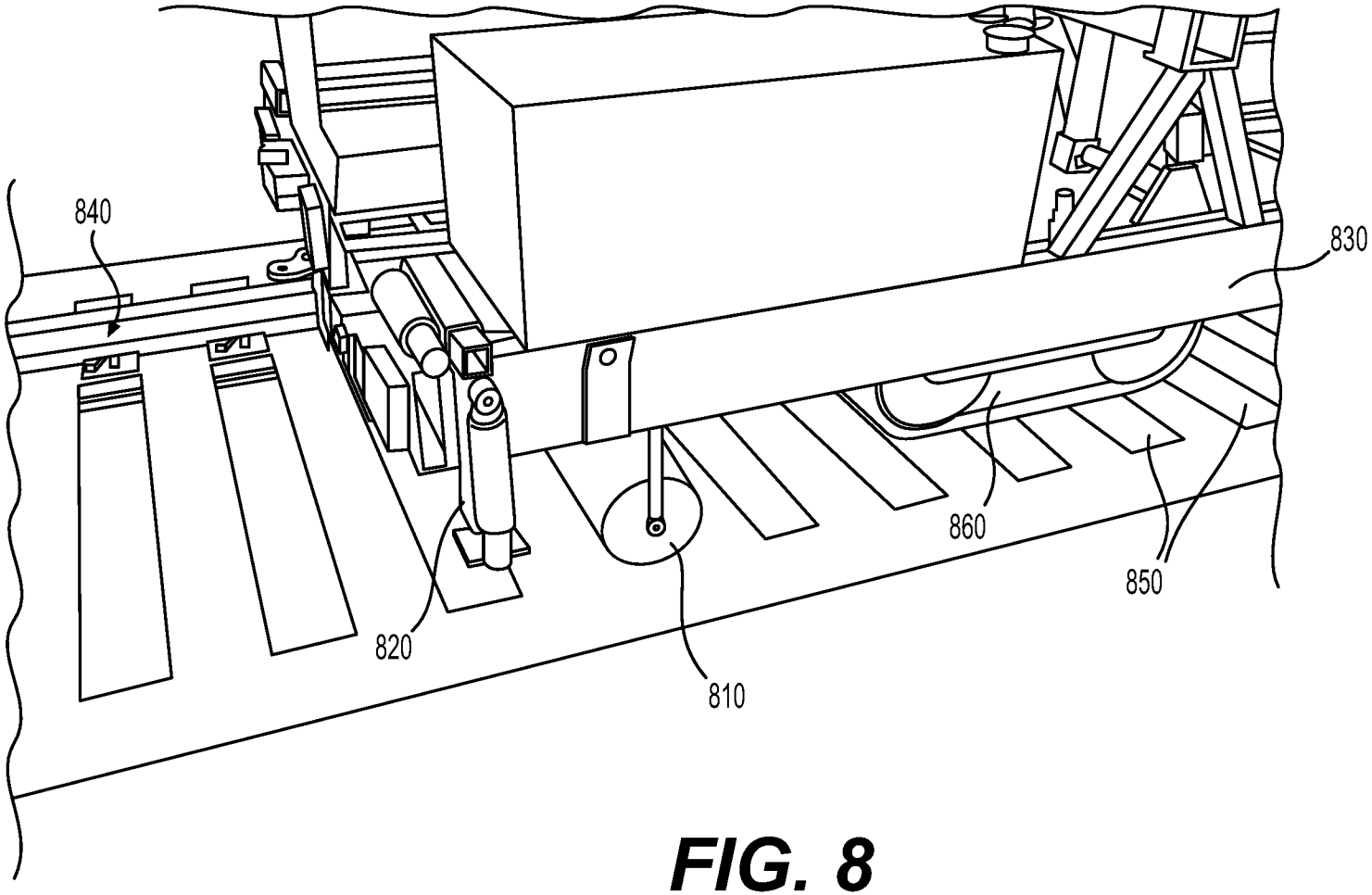
Figure 9:
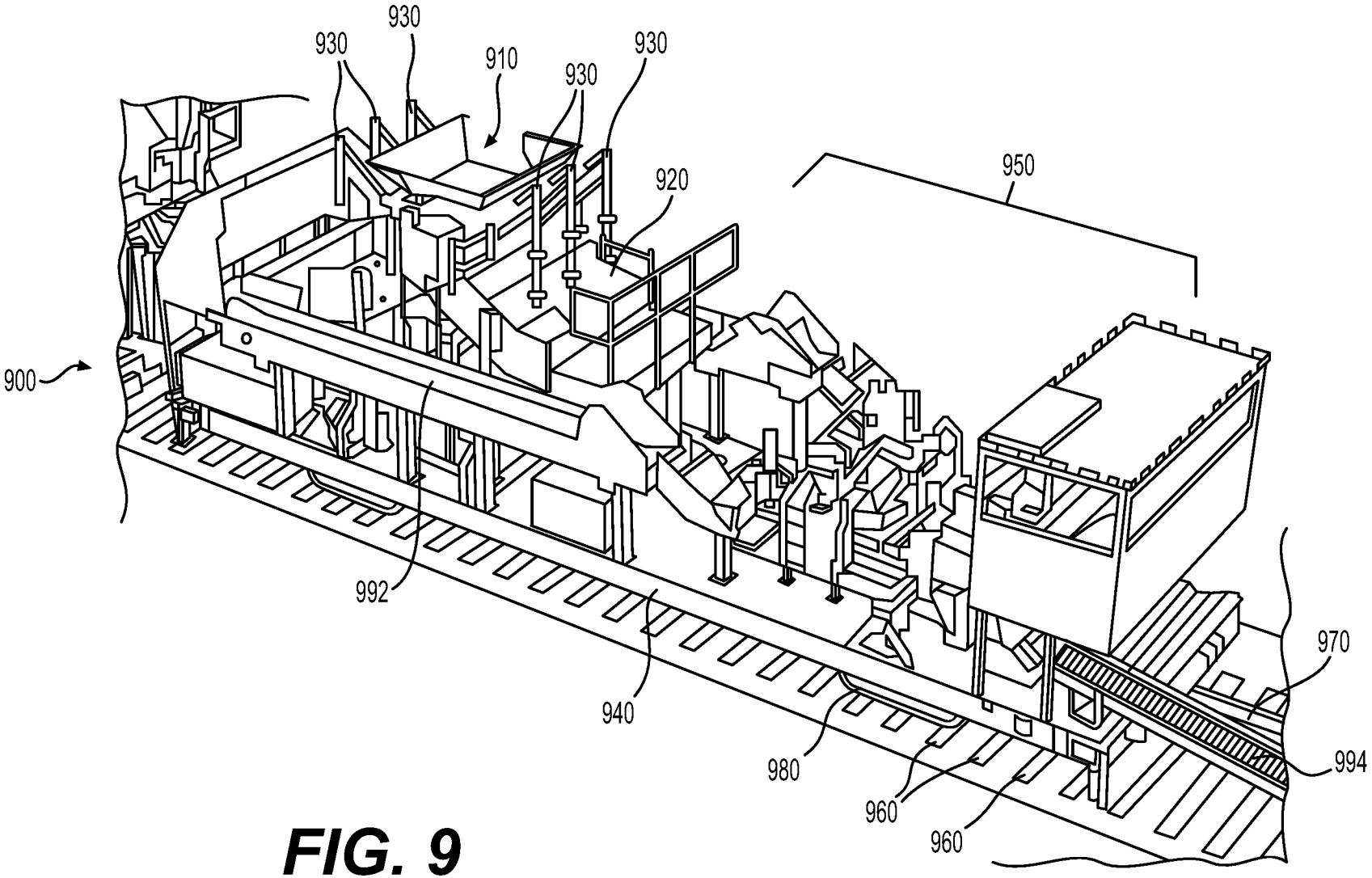
Figure 10:
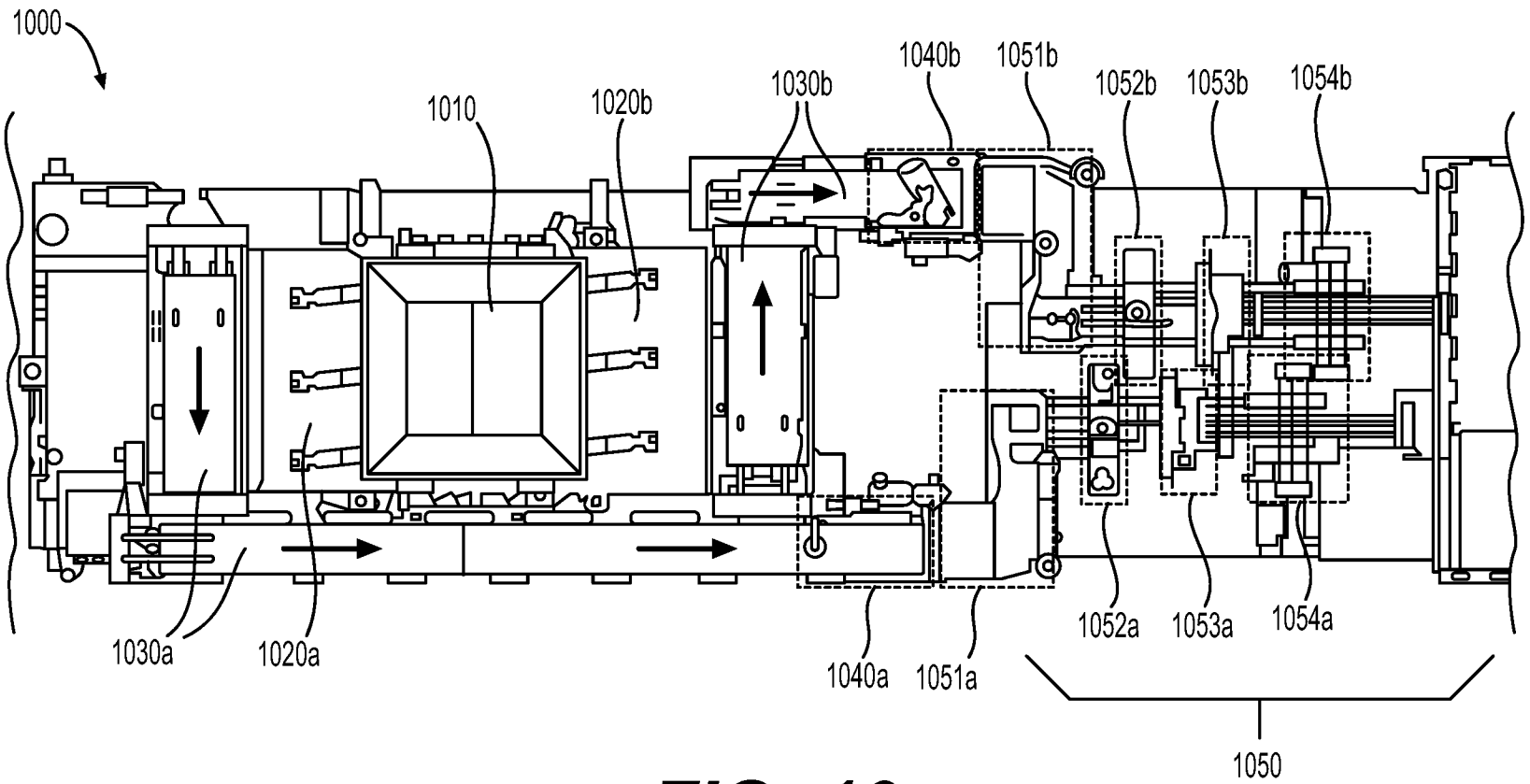

FIG. 4 depicts a hopper machine showing a storage hopper 410 proximate to an excavator 420 positioned on a pedestal 424;

FIG. 5 depicts a top down view of a storage hopper 510 on a hopper machine 500;

FIG. 6 depicts an excavator 620 mounted on a pedestal 624 proximate to a storage hopper 610 of a hopper machine;

FIG. 7 depicts a top down view of an excavator 720 proximate to a storage hopper 710 with its boom 721 and stick 722 positioned within the storage hopper 710 of a hopper machine;

FIG. 8 depicts the forward leading end of a hopper machine showing a railroad tie sweeper 810 positioned below the frame 830, a jack 820, and a crawler 860 positioned to run over the railess railroad ties 850;

FIG. 9 depicts a handling machine 900 with an anterior receiving hopper 910 and posterior sorting/orientation stations 950;

FIG. 10 depicts a top down view of a handling machine 1000 with, from left to right, transfer conveyor 1030*a*, pick area 1020*a*, receiving hopper 1010, pick area 1020*b*, transfer conveyor 1030*b*, dual pick separator stations 1040*a/b*, side orientation stations 1051*a/b*, tie plate orientation detectors 1052*a/b*, right/left orientation stations 1053*a/b*, and up/down orientation stations 1054*a/b;*

Figure 11:
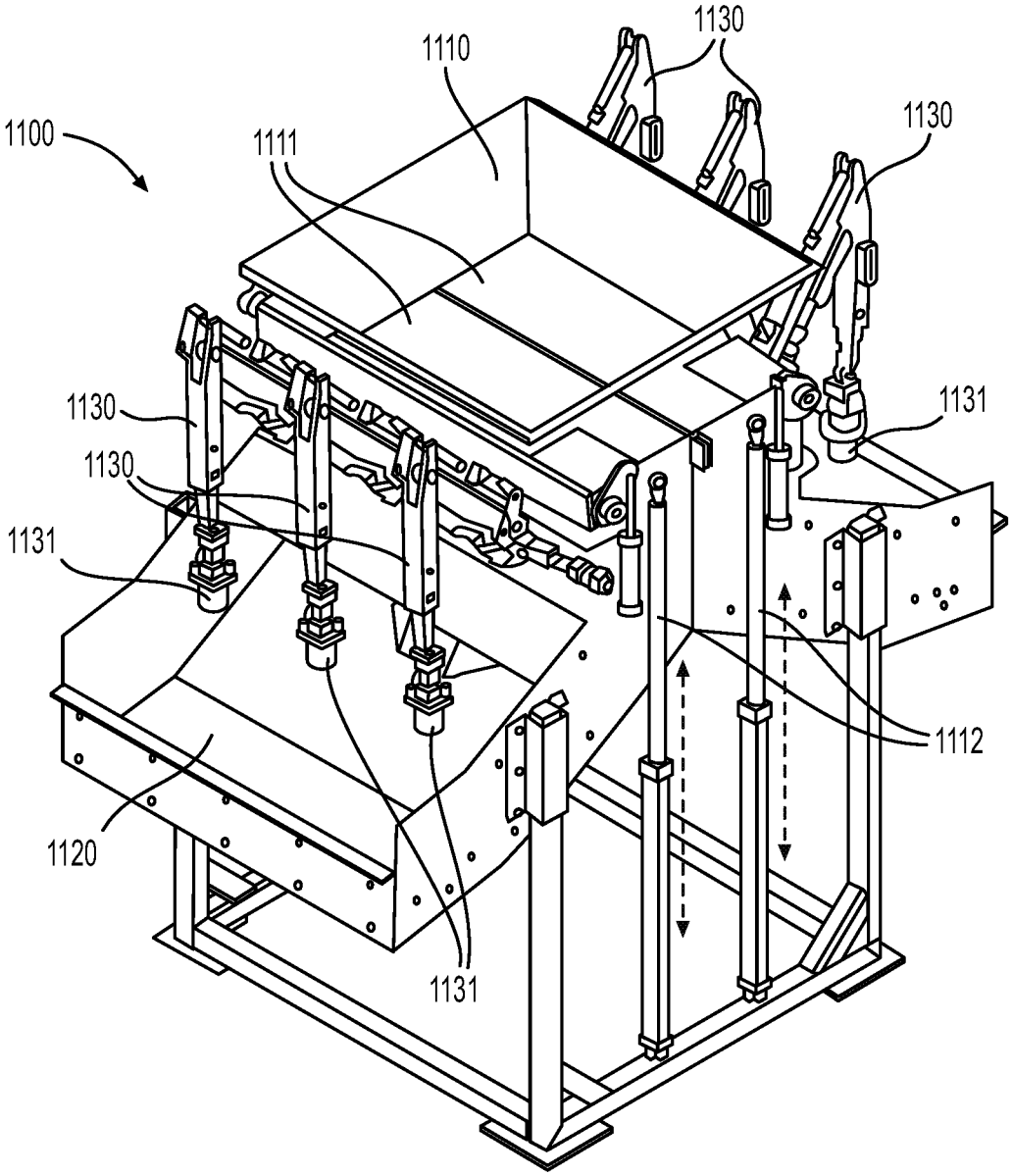
Figure 12:
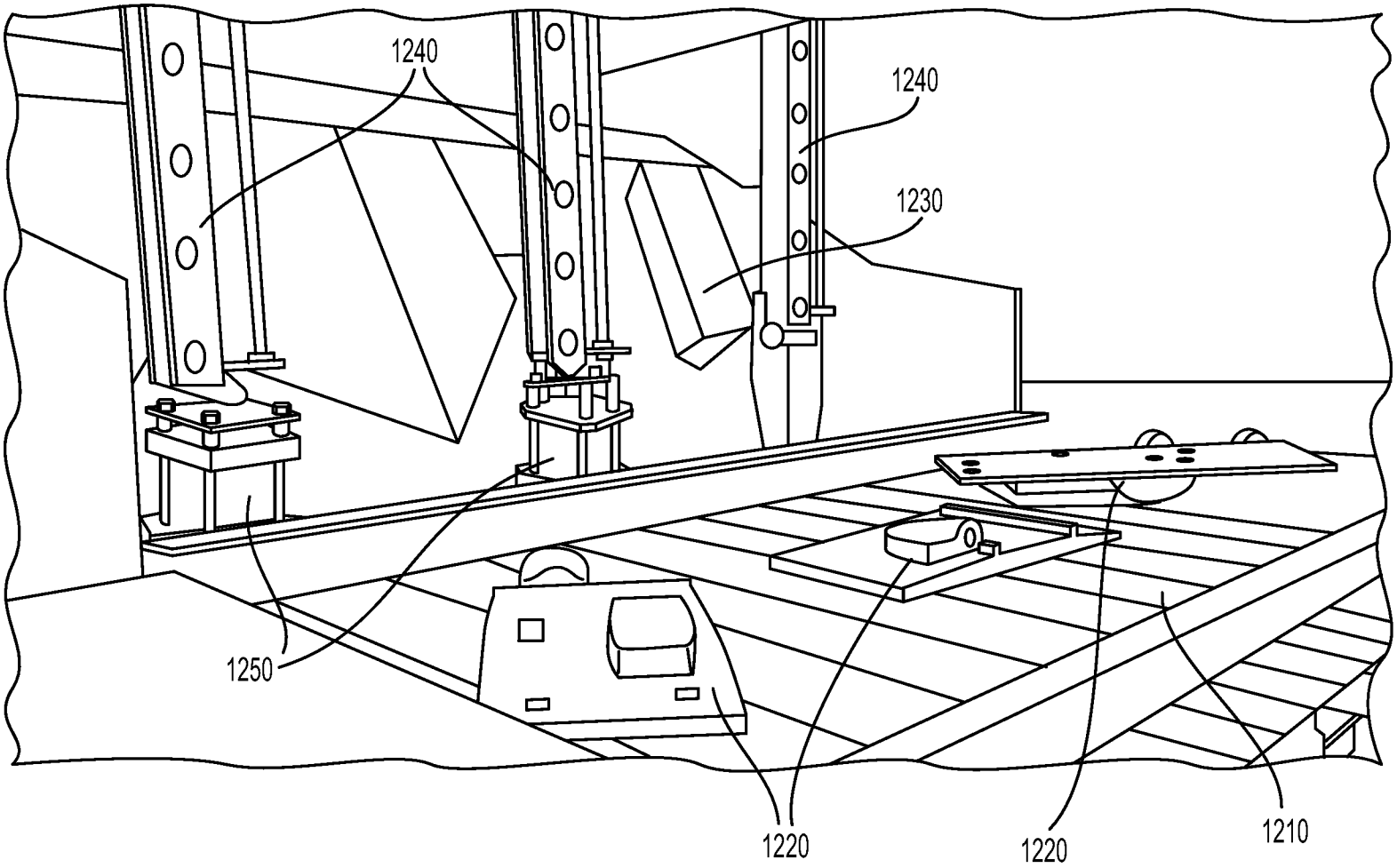
Figure 13:
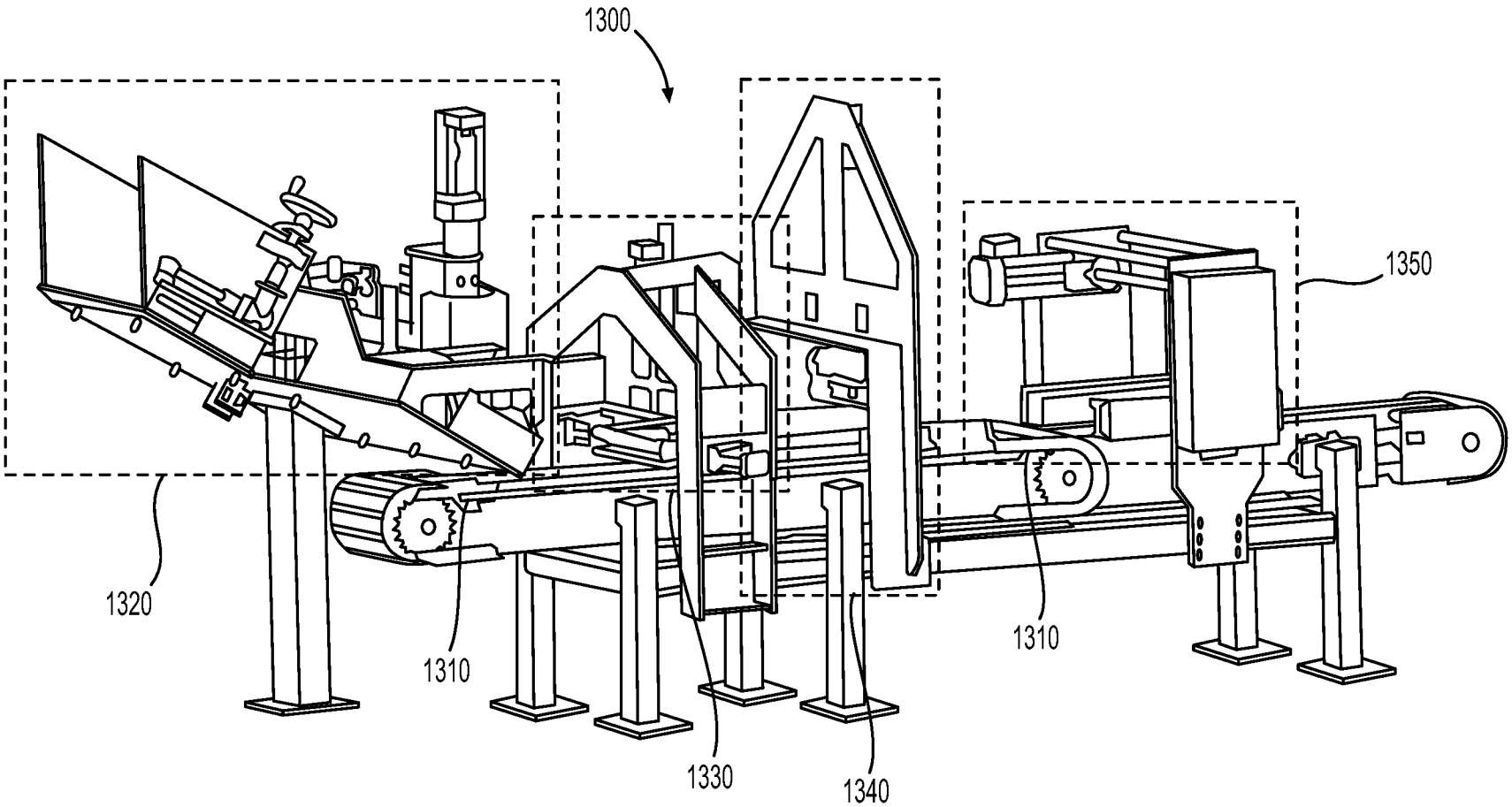
Figure 14:
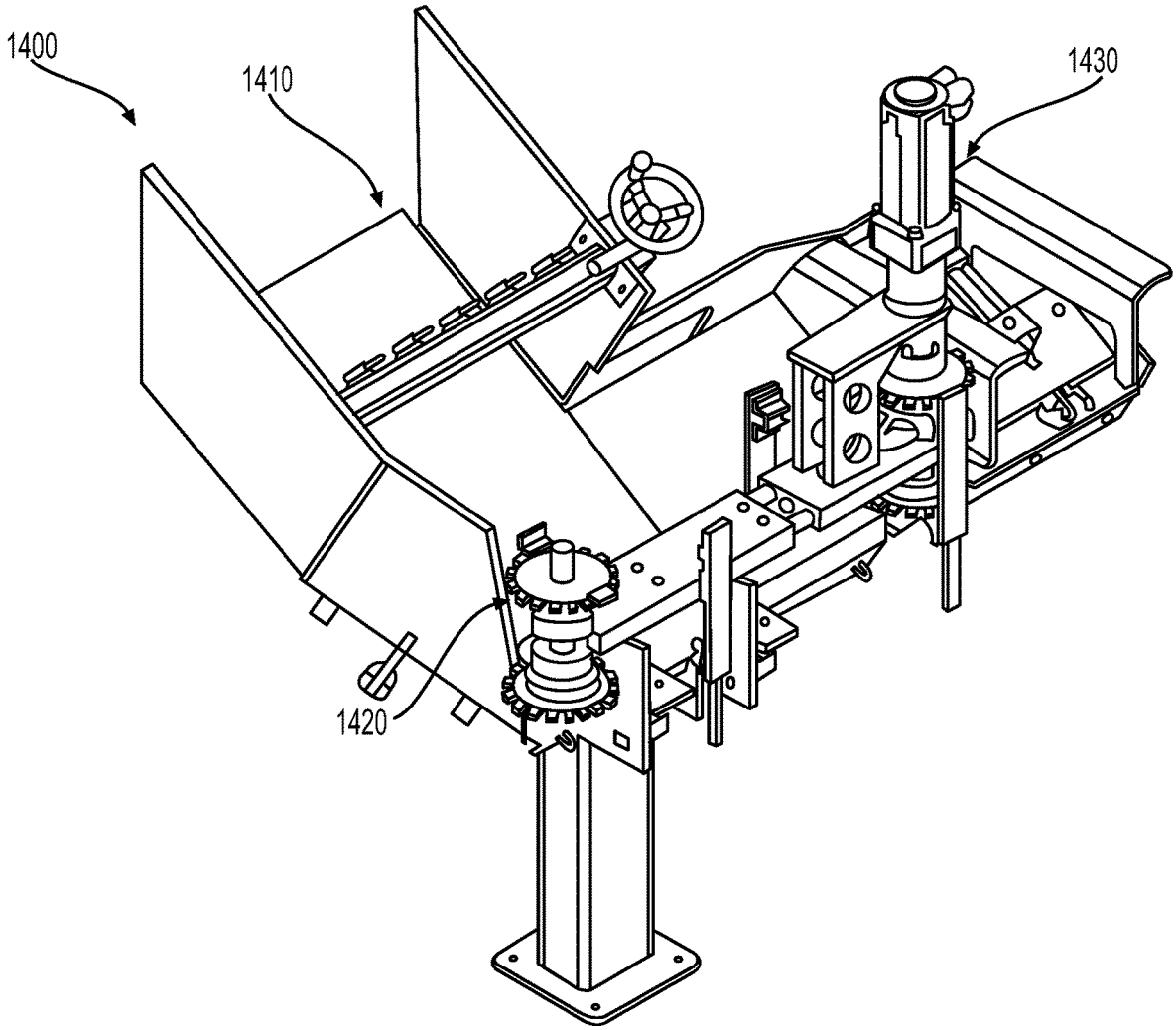
Figure 15A:
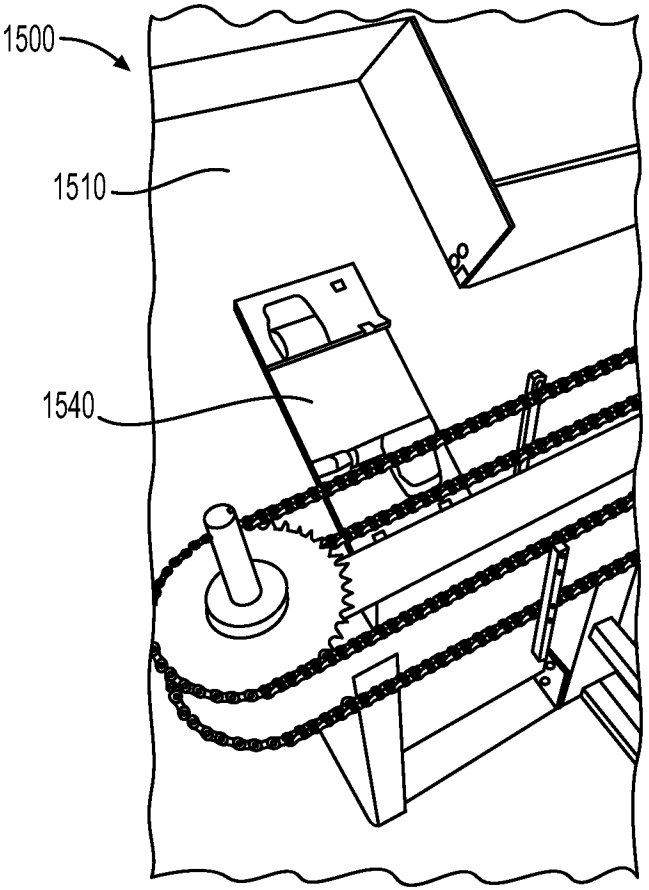
Figure 15B:
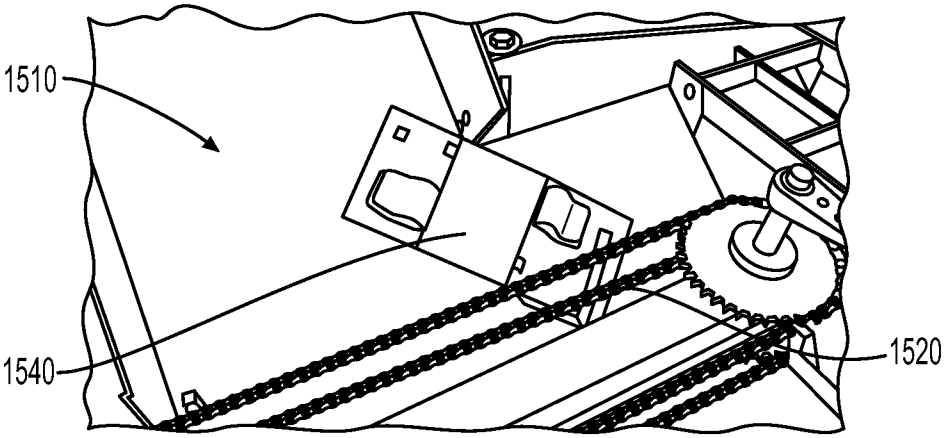
Figure 15C:
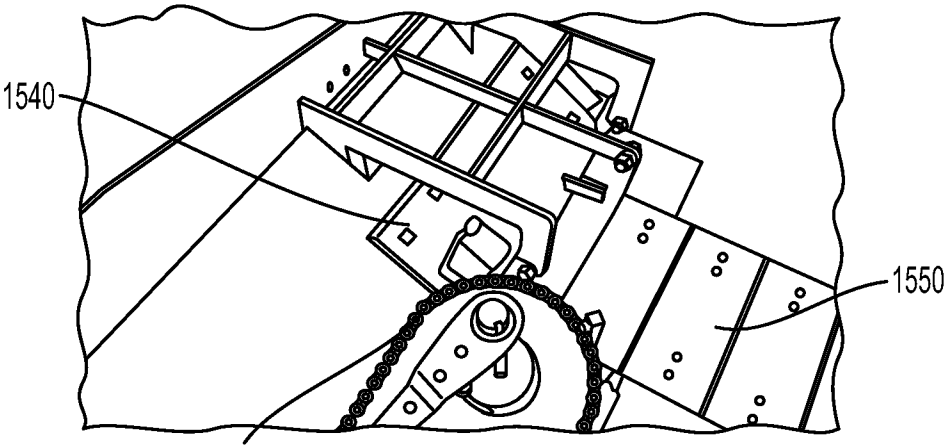
Figure 16:
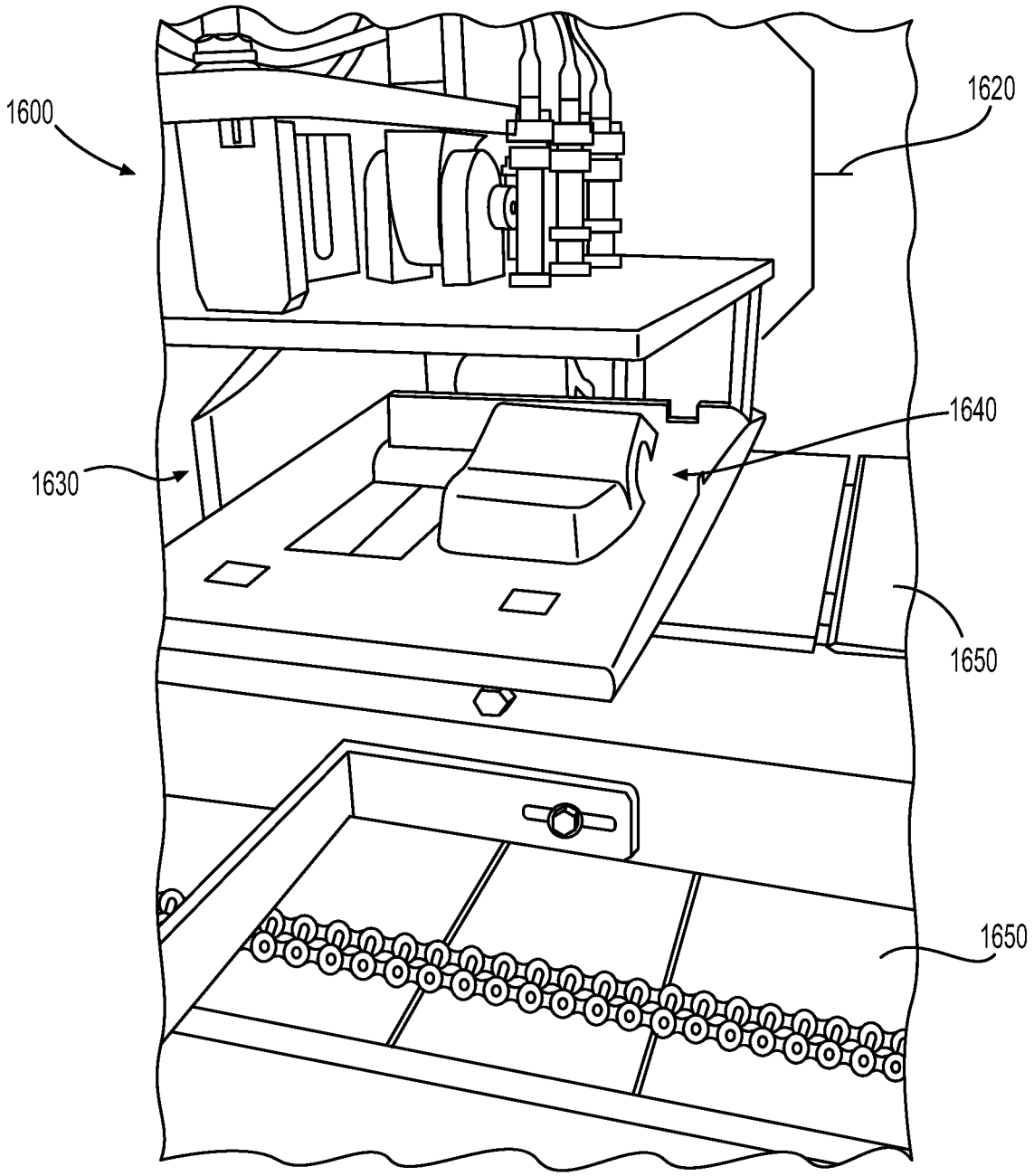
Figure 17B:
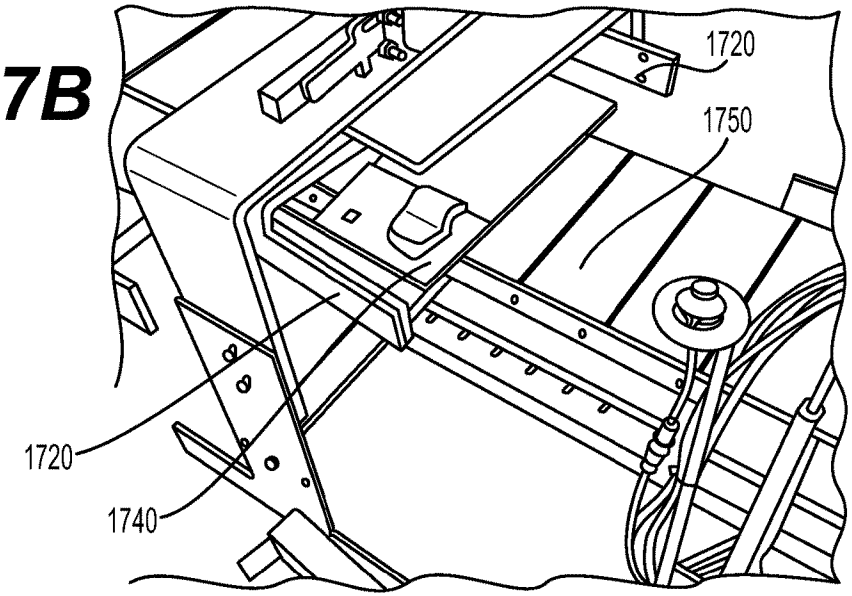
Figure 17C:
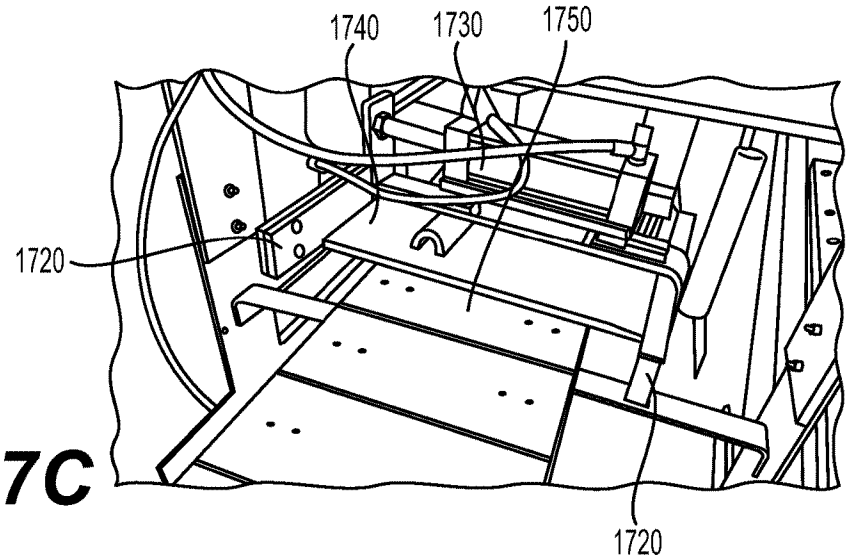
Figure 17A:
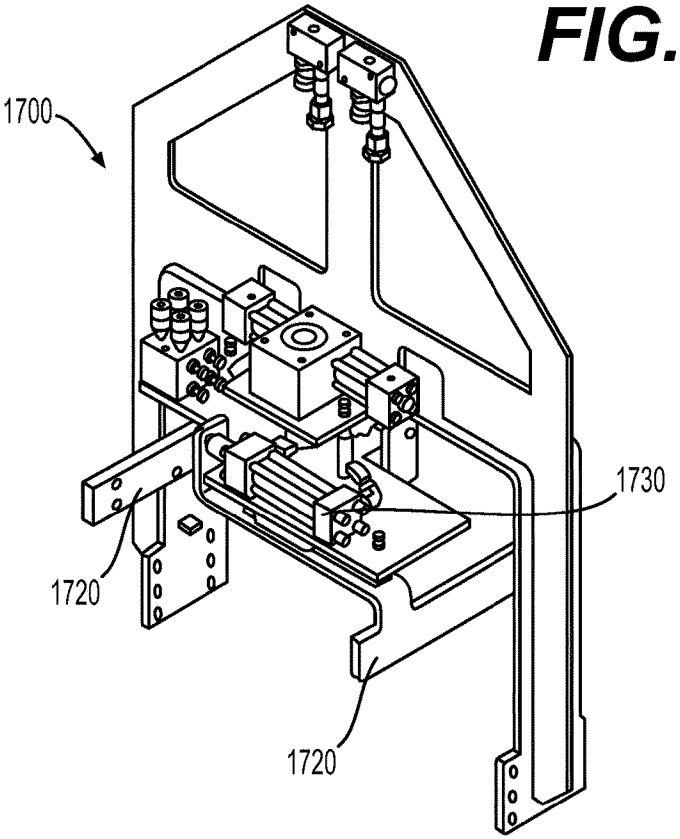
Figure 18B:
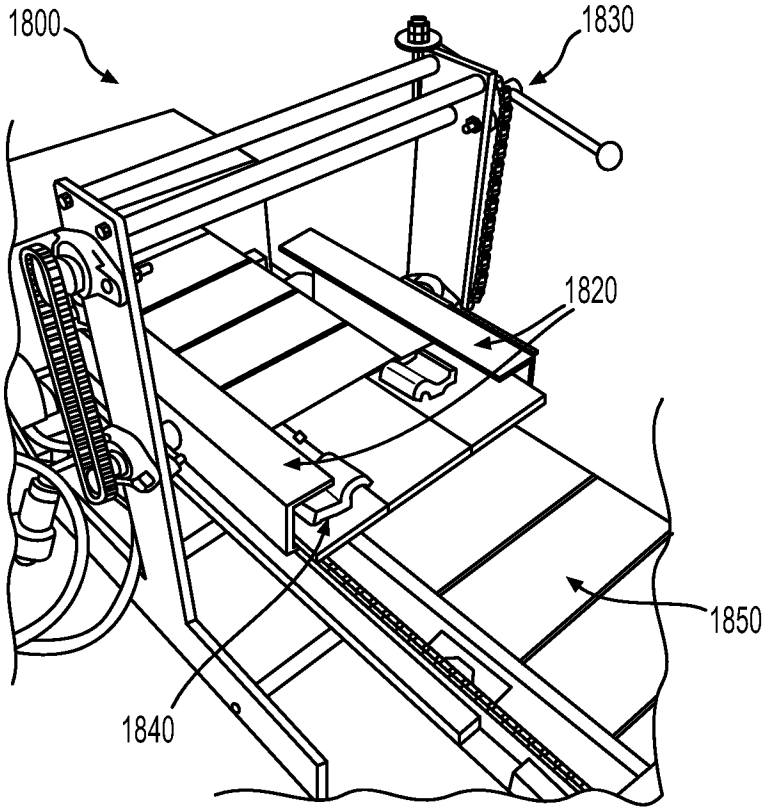
Figure 18A:
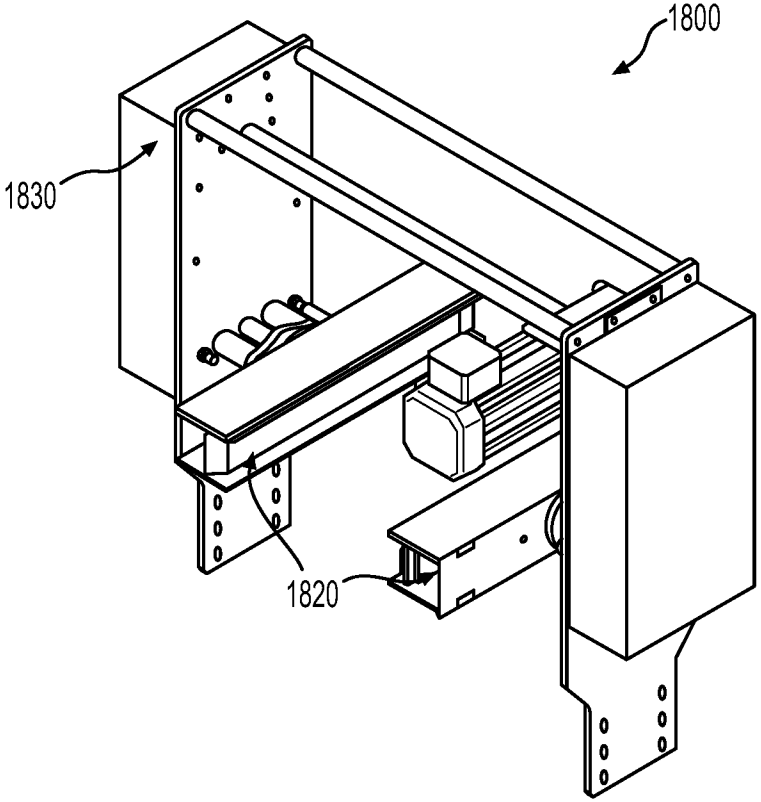
Figure 19:
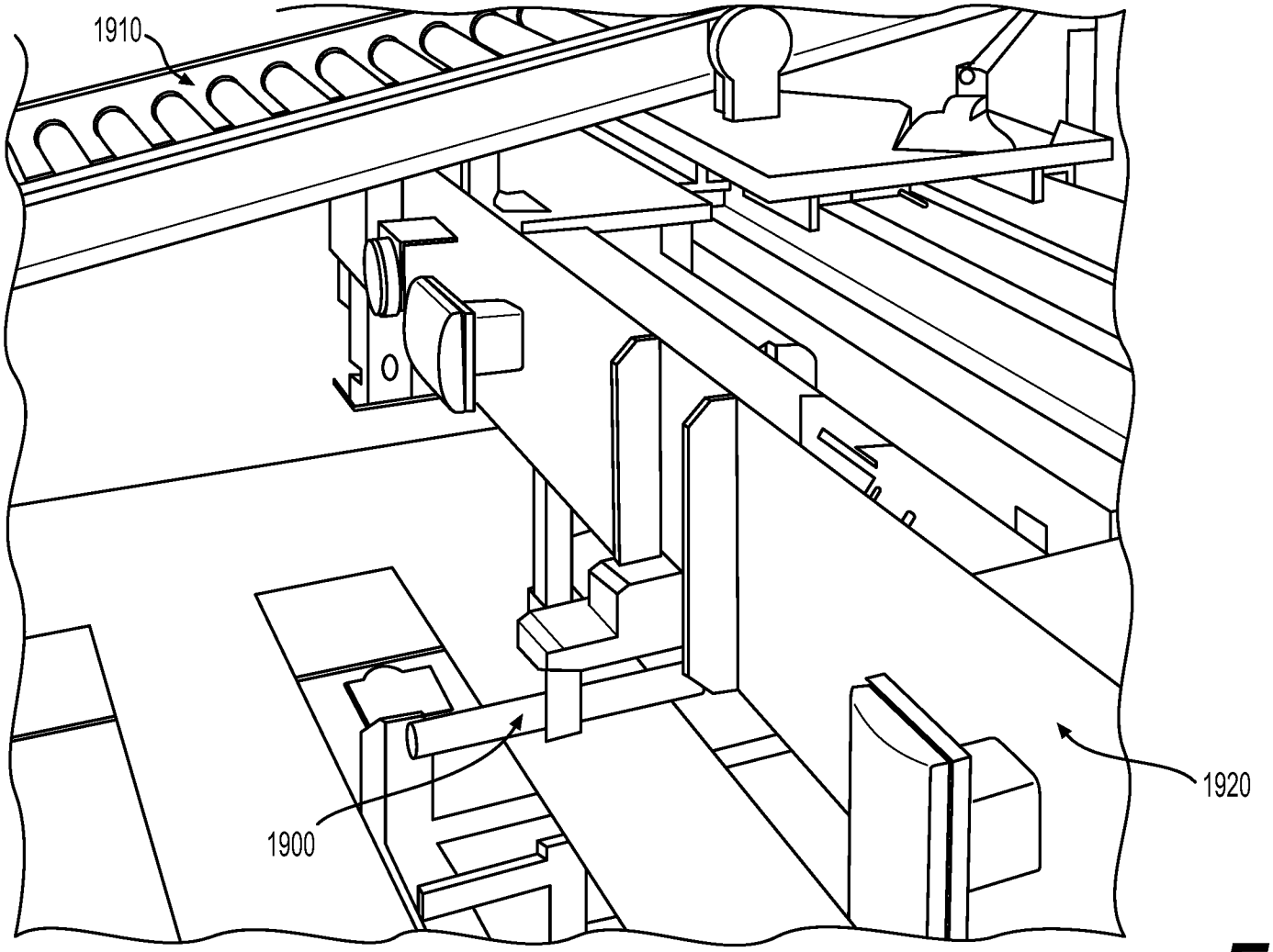
Figure 20:
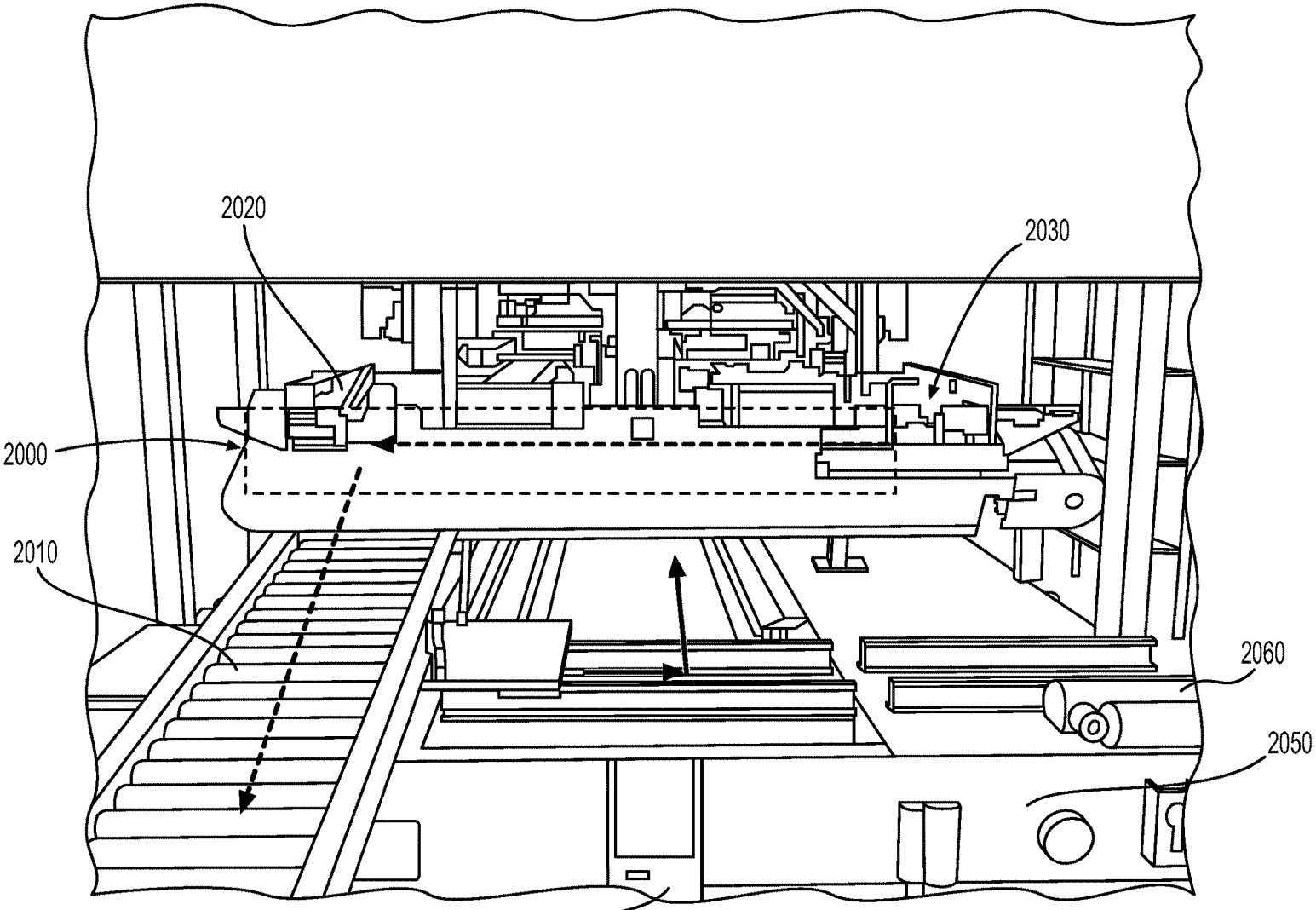
Figure 21B:
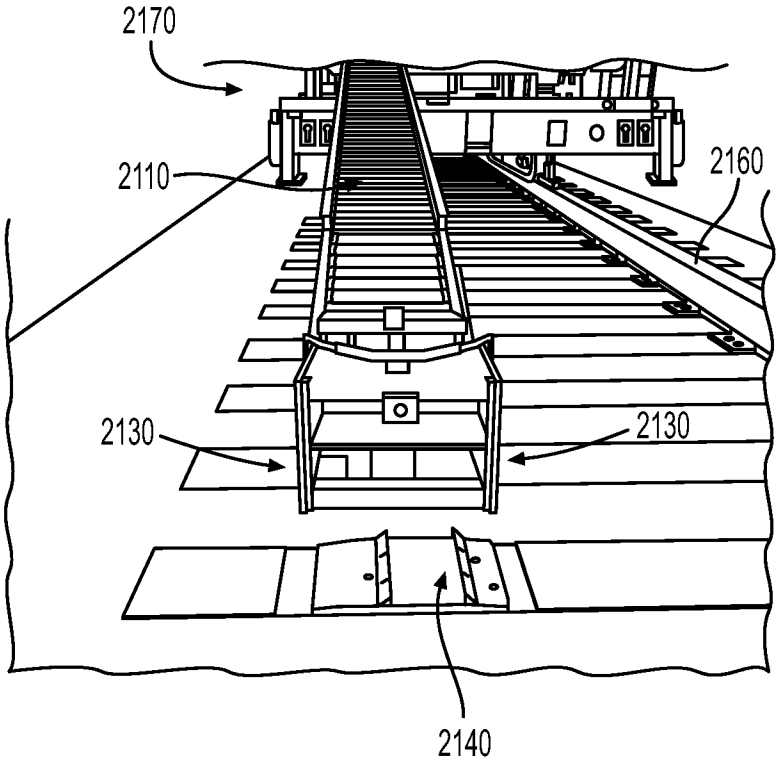
Figure 21A:
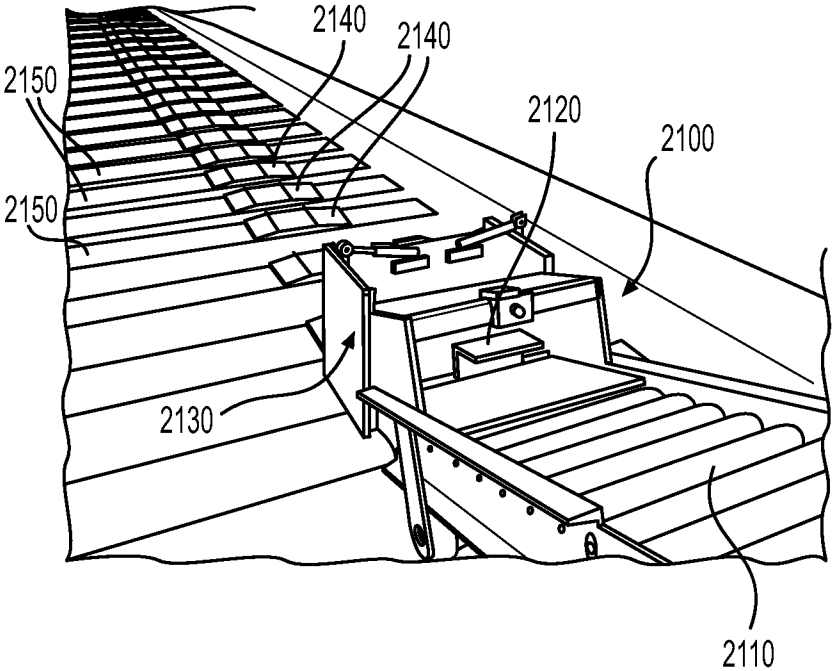
Figure 22:
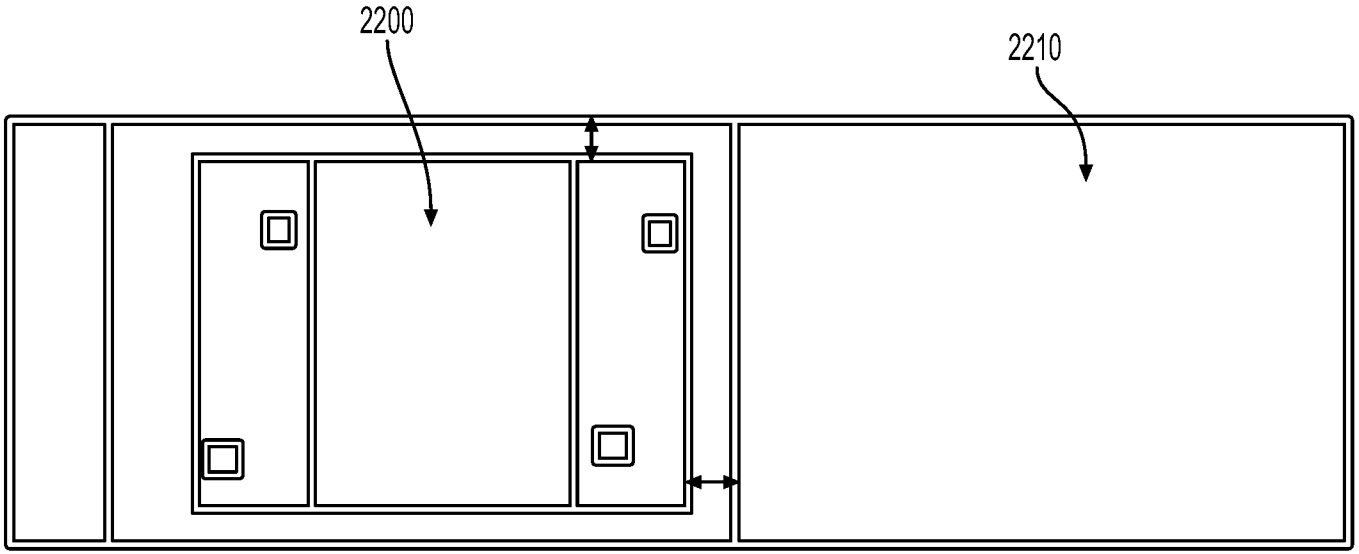

FIG. 11 depicts a receiving hopper assembly 1100 with hopper 1110, hopper doors 1111, pick areas 1120, pick and place arms 1130, and hopper door hydraulic cyclinders 1112, the broken line arrows represent the up and down movement of the hydraulic cylinders 112 to open and close the hopper doors 1111;

FIG. 12 depicts a transfer conveyor 1210 with tie plates 1220 proximate to a pick area 1230 with pick and place arms 1240 with magnetic heads 1250;

FIG. 13 depicts a side view of a tie plate sorting/orientation station 1300 with sorting conveyor 1310, side oprientation station 1320, orientation detector 1330, right/left orientation station 1340, and up/down orientation station 1350;

FIG. 14 depicts a side orientation station 1400 with chute 1410, mechanical wiper 1420, and servomotor 1430;

FIG. 15A depicts a side orientation station 1500 with a tie plate 1540 having dropped down the chute 1510;

FIG. 15B depicts the side orientation station 1500 with the tie plate 1540 contacting a mechanical wiper 1520;

FIG. 15C depicts the side orientation station 1500 with the reoriented tie plate 1540 contacting a conveyor 1550;

FIG. 16 depicts an orientation detector 1660 with a tie plate 1640 adjacent to a plate positioner 1630 below a sensing head 1620;

FIG. 17A depicts a right/left orientation station 1700 with solenoid 1730 powered squeeze panels 1720 for gripping a tie plate;

FIG. 17B depicts the right/left orientation station 1700 with the tie plate 1740 positioned between but not squeezed by the squeeze panels 1720 on a sorting conveyor 1750;

FIG. 17C depicts the right/left orientation station 1700 with the tie plate 1740 positioned between and squeezed by the squeeze panels 1720 on the sorting conveyor 1750;

FIG. 18A depicts an up/down orientation station 1800 with a drive motor assembly 1830 and a pair of rotation curbs 1820 for reorienting a tie plate;

FIG. 18B depicts the up/down orientation station 1800 with the drive motor assembly 1830 exposed and the pair of rotation curbs 1820 encompassing the ends of the tie plate 1820, which is positioned on a sorting conveyor 1850;

FIG. 19 depicts the posterior end of a handling machine platform 1920 showing the retractable ATLAS device 1910 and the retractable sled conveyor 1910;

FIG. 20 depicts a posterior end view of a handling machine platform 2050 showing a left transfer conveyor 2020 and a right transfer conveyor 2030 converging at a combination station 2000 to move tie plates onto a sled conveyor 2010 following the broken line arrow, and showing the movement of the sled conveyor 2010 to the center of the platform 2050 for stowing according to the solid line arrow;

FIG. 21A depicts a tie plate placing sled 2100 at the end of a sled conveyor 2110 with a tie plate stop 2120 and tie plate release arms 2130, and previously placed tie plates 2140 are shown fixed to ties 2150;

FIG. 21B depicts a posterior end view of the placing sled 2100 trailing the handling machine 2170 showing the laterally positioned tie plate release arms 2130, and a previously placed tie plate 2140 on a tie; and FIG. 22 depicts a diagram of a tie plate 2200 placed onto a section of a railroad tie 2210.

Appended herewith and incorporated herein by reference in its entirety is an appendix of colored computer assisted drawings and photographs numbered 1-38 and entitled "The Appendix".

DESCRIPTION

Referring to the figures herein, the tie plate distribution system 100 may handle and place tie plates 1220, 1540, 1640, 1740, 1840, 2140, 2200 accurately and consistently in the final location needed for spiking. The system is generally comprised of two machines operating in unison. The two machines are a hopper unit and a placing unit. Both the hopper unit and the placing unit will preferably be capable of operating under their own power, but when in use will either be physically linked, or timed such that they travel in a synchronous manner. The hopper unit will be responsible for loading plates from the side of the track into a central holding hopper prior to and during plate laying operations. During operation, the hopper machine 110, 400, 500 will load plates to the handling machine 130, 900, 1000, 2170. The handling machine 130, 900, 1000, 2170 will sort and orient the plates 1220, 1540, 1640, 1740, 1840, 2140, 2200, and lay them on the correct side of track. Both machines will preferably include crawler tracks 117, 230, 660, 860, 980 for the side where plates are being laid, and will operate on rail gear 260, 360, 670 on the opposing side, which rides over a single rail 170, 240, 340, 440, 540, 640.

The tie plates 1220, 1540, 1640, 1740, 1840, 2140, 2200 may be of a variety of sizes. In particular, a typical embodiment will be configurable for a variety of tie plate sizes. In exemplary embodiments, tie plates may be 16 inches wide and the system may accommodate ties of a variety of standardized designs.

Figure 1:
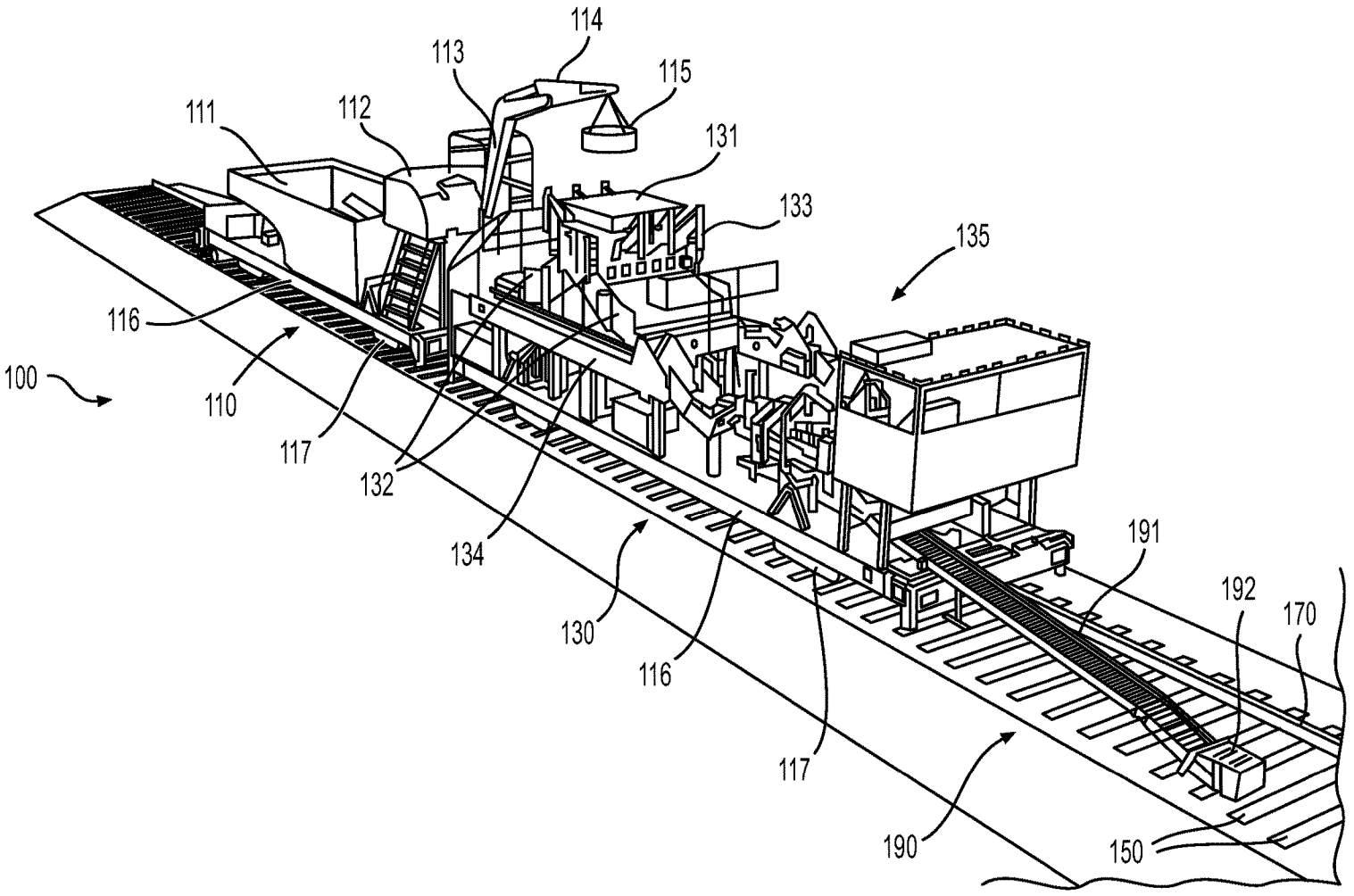

The machines are preferably equipped with crawler tracks 117, 230, 660, 860, 980, to allow the machine to travel simultaneously on one rail, and the top of the ties on the opposite side, when in work mode. An example of this operation is shown in FIG. 1. Both sides of each machine will be equipped with crawler tracks, as well as (at a minimum) tracks located at the front and rear of the machine.

Figure 2:
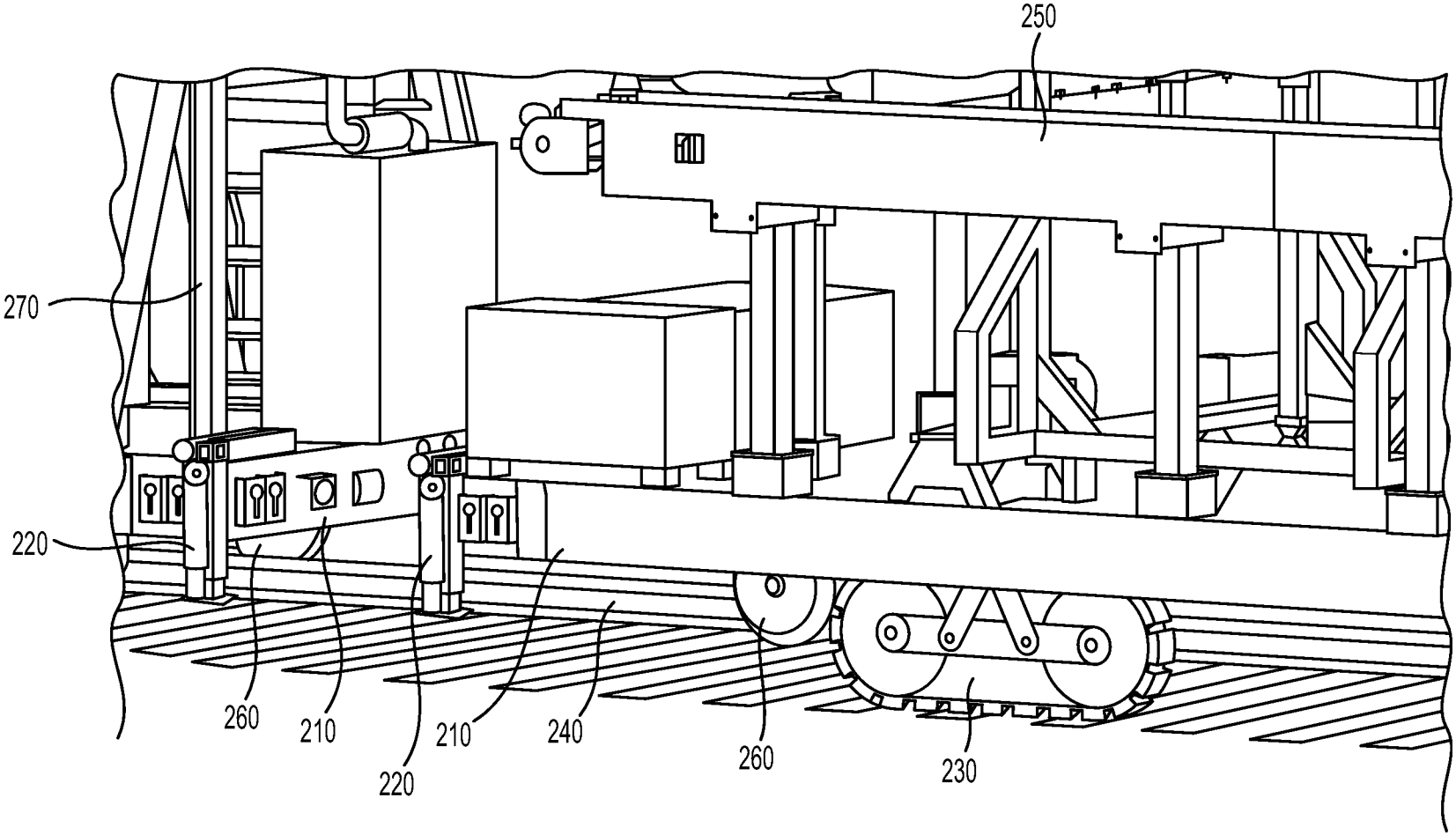
FIG. 2 depicts a section of a handling machine (to the right) proximate to the hopper machine (to the left)

As shown in FIG. 2, the crawler tracks are preferably adjustable to allow the machine to crawl into and out of various work areas (i.e., across bridges, tunnels, crossings, etc.). The crawler tracks are deployable and retractable to be moved between working and stored positions. In the stored position the crawler tracks are preferably positioned above a minimum of 4 inches from the top of the rail 170, 240, 440, 540, 640, 840, 970, 2160, 2210. In work mode, the crawler tracks are capable of independent steering to allow for curve negotiation.

Figure 3:
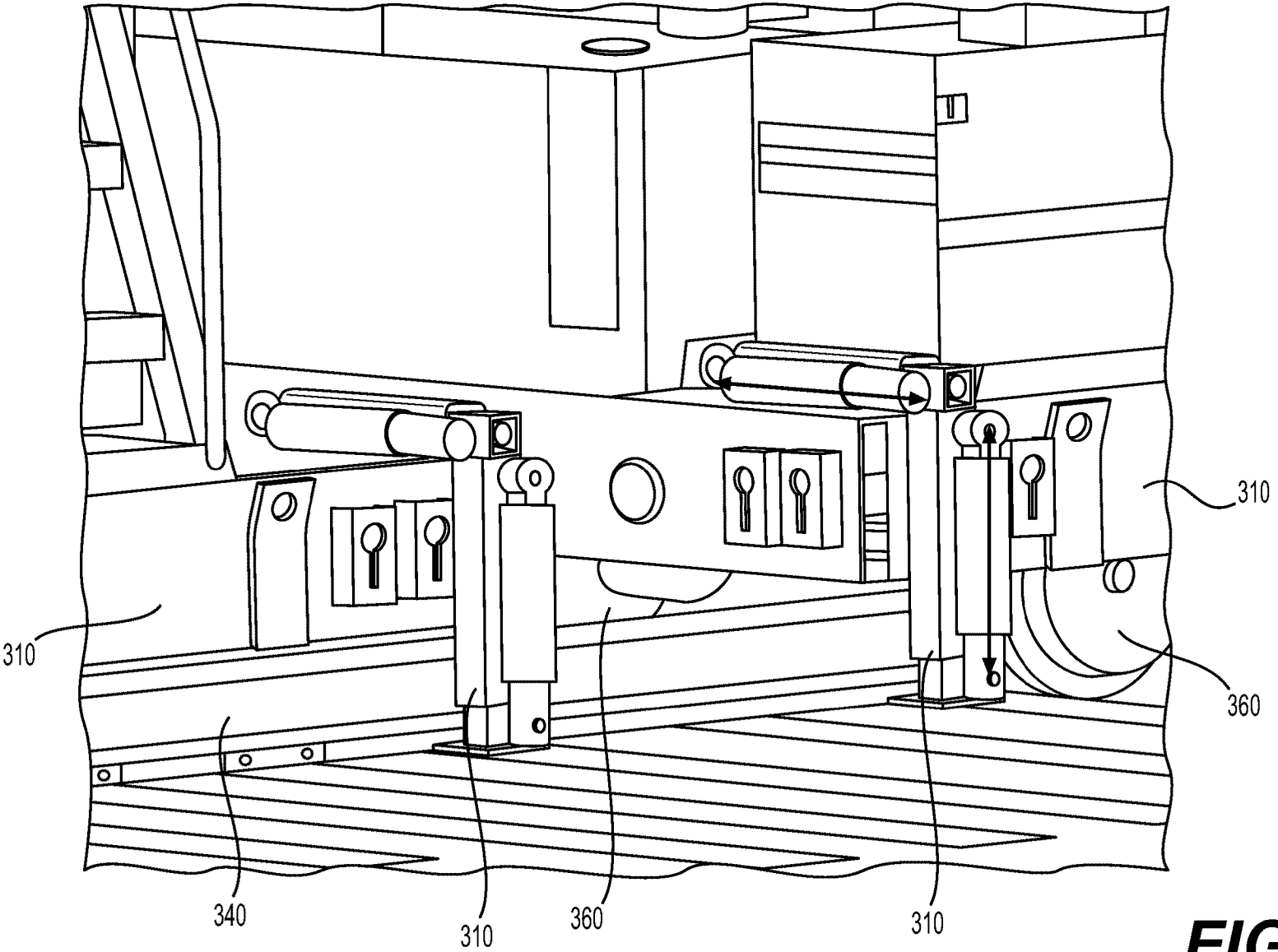
FIG. 3 depicts the junction between a hopper machine (left) and a handling machine (right) and the jack system 310.

In some embodiments, one or both machines should be identical, with only above deck modifications for each variation. As shown in FIG. 3, a hydraulically deployed jack system 220, 320, 820 may be installed on the frame 310 to facilitate lifting the machine in service, for converting between work and travel modes, or in the event of a derailment or track malfunction. The jack system should provide adequate means for lock out/tag out procedures when in use. The jack system may include outriggers 311 as well to facilitate jacking of the machine. The outriggers should allow for in/out travel and the jacks will move the machine up and down. An example of the jacking system is provided in FIG. 2 and FIG. 3.

The Hopper machine 110, 400, 500 facilitates loading the plates from the side of the track, to a central storage hopper 110, 410, 510, 610, 710. This permits supplies of tie plates to be stages along the route of a track by over-the-road trucks. An example machine is shown in FIG. 4.

The hopper machine 100, 400, 500 will load plates prior to and/or during work. The hopper 110, 410, 510, 610, 710 on the machine should be capable of holding a sufficient number of tie plates 1220, 1540, 1640, 1740, 1840, 2140, 2200 to permit the system to place plates along a distance between pre-staged tie plate supplies. The hopper 510 is generally shown in FIG. 4 and FIG. 5. The hopper on the machine may be removable when empty, to facilitate servicing or cleaning if needed.

In some preferred embodiments, tie plates may be picked up and loaded into the hopper by a machine 520, 620, such as a CATERPILLAR model 308E2 long stick mini hydraulic excavator 112, 420, 520, 620, 720. An example of the excavator setup on a hopper machine is shown in FIGS. 4-7.

The excavator 112, 420, 520, 620, 720 may be mounted on a platform 116, 210, 310, 430, 530, 630, 730, 830, 940 towards the end of the 110, 400, 500 closest to the placing machine 130, 900, 1000, 2170, the under carriage will be removed from the excavator and placed on a pedestal 270, 424, 624. The height of the excavator on the pedestal is preferably high enough for the operator to see the bottom of the storage hopper 111, 410, 510, 610, 710, as well as the side of the loading hopper 131, 910, 1010, 1110 on the placing machine 130, 900, 1000, 2170. The excavator will typically operate under its own hydraulic and power, independent of the systems used to move the hopper machine 110, 400, 500. The excavator may be provided with an electromagnet system 115, 423, 623 moving plates.

In some embodiments, the storage hopper shall allow for the boom/stick 113/114, 421/422, 621/622, 721/722 to collapse and be stored inside of it, and secured safely for travel, example of which is shown in FIG. 7. A divider may be installed in the middle of the hopper to allow for separation of two different types of plates. This, in turn, will permit the operator to select the type of plate that may be required in a particular location.

A camera system may be included with the hopper unit that allows the operator to visually monitor the front and back of the machine, as well as the hopper and the end of the stick. In some such embodiments, the cameras may be linked through a data network to facilitate remote monitoring of tie plate distribution operations.

A push broom 810, as shown in FIG. 8, may be attached to the undercarriage of the machine to clean any ballast from the tops of the ties to prevent tie plates from being positioned on top of the loose ballast. Additionally, a grate may be installed on the bottom of the hopper unit to facilitate filtering any accumulated debris (spikes, clips, etc.), and to prevent the debris from entering into the pick and place hopper 131, 910, 1010, 110 of the handling car.

An overview of the handling machine 900 is provided in FIG. 9. In general loads of plates delivered by the excavator/magnet 620/623 may be dropped into a receiving hopper 131, 910, 1010, 1110. From there they will be picked up and arranged into a single file row. In some embodiments, this may be accomplished using a hydraulically driven arm 133, 930, 1130, 1240. In such embodiment, three arms will be located on each side of the receiving hopper, and the arms will operate in unison. The arms will lower into the received plates, energize a magnet 1131, 1250, and lift a single plate 1220. The arms will transfer the single plate onto a conveyor 134, 250, 992, 1030, 1210 to proceed to the next station. This area is shown in FIG. 10.

The bulk receiving hopper 131, 910, 1010, 1110 should preferably be sized to accept and hold two or more drops from the supplying bulk magnet 115, 424, 623. The receiving hopper should hold the bulk plates above the single-pick area until the single-pick magnets 1131, 1250 are clear of the area so that they are not damaged by the drop of the bulk plates.

Actuators 1112 may be used to release doors 1111 and drop the plates as shown in FIG. 10.

The placing machine may be provided with two single-pick areas 1120. A single dump from the bulk receiving will divide evenly into the two pick areas 132, 920, 1020, 1120, 1230. Sensors will be arranged to determine if the single-pick area is too full, or if it's ready to accept another drop. This information will be used to help control the doors of the receiving area.

In some embodiments, as shown in FIGS. 10 and 11, there will be a total of six single-pick magnet arms 133, 930, 1130, 1240. Each arm may be capable of picking from two places in the single pick area. Each arm will alternately pick between its two places 132, 920, 1020, 1120, 1230. Each arm will be capable of motion such that it can pick from the single pick area, lift the picked plate upward clear of the walls of the single pick area, and then set the picked plate down on a conveyor 134, 250, 992, 1030, 1210, 2020/2030 adjacent to the single pick area. Throughout its motion, each arm should be of sufficient strength to lift and hold the magnet assembly 1131, 1250 in combination with two of the largest plates, with a suitable safety factor. Each arm should incorporate a detection sensor to stop its downward motion when it has come into contact with something, so that excessive downward force is not experienced by any of the mechanisms. Preferably, location sensors are incorporated into each arm to detect its various positions so that its motion can be sensor driven and not depend on programmed timers.

Optionally, the receiving hopper may include hydraulic cylinders 1112, screws, or other means for raising and lowering it between work and travel positions as shown in FIG. 11.

A single magnet 1131, 1250 may be located at the end of each single pick arm, as shown in FIGS. 11 and 12 and a single magnet will be used for each Double Pick Separator 1040 downstream, for a total of 8 magnets in the system. Each magnet needs to be able to pick a plate from the single pick. Magnets can be electric or use a mechanical stripper plate to turn them on and off. If electric magnets are used, they should be sized and designed such that they will not overheat when used for extended periods or at elevated ambient temperatures. If using electric magnets, a variable strength system would be beneficial for control pick strength for different plate designs.

Transfer conveyors 1030*a/b* may be used to transfer the picked plates to the sorting stations 1040*a/b*, 1051*a/b*, 1052*a/b*, 1053*a/b*, 1054*a/b*, as shown in FIG. 10. The transfer conveyors will preferably have variable speed control and the capability of stopping and starting in less than ¼ second. FIG. 12 shows how the magnets have placed the tie plates 1220 on the transfer conveyor 1210. Tie plates can be oriented in any direction when they are placed on the first level of the orientating system. In use, the transfer conveyors will be stopping approximately every 1 to 2 feet of travel. At every transition from one conveyor to the next or from one conveyor to the next station, there should to be sensors to identify when a plate has transferred. This sensor tripping will stop the feeding conveyor long enough for some distance to be created between each plate on the receiving conveyor. In some embodiments, this spacing may be critical to prevent jams in downstream machines.

Generally, there may be two parallel paths of transfer conveyor leading to two parallel sorting systems working independently, as shown in FIG. 10. The transfer Conveyors may incorporate a Double Pick Separator 1040*a*, 1040*b* positioned as shown in FIG. 10, which function to remove excess plates placed on the transfer conveyor. The double pick separator may use a sensor to detect when a plate is positioned too high on the conveyor, indicating that it must be a stack of plates. When the sensor is tripped, a magnet will be used to pick the top plate off of the lower plate and transfer it into the open space behind the lower plate. If the high plate sensor is still tripped after the magnet operates, the stack of plates will be conveyed into the next station, where it will be rejected out the side of the car, beside the rail bed or other suitable location. In other embodiments, the system may include a means for recycling discarded plates to the hopper so that reorienting them may be attempted again.

The sorting conveyor 1310 is used to transfer the plates from each sorting station to the next and is generally shown in FIG. 13. The sorting conveyor 1310 should be constructed of material that will withstand the impact and sliding abrasion of the plates. The sorting conveyor will preferably be constructed to adequately support the plates at the various sorting stations. The sorting conveyor may be indexed by a hydraulic cylinder and will typically advance 24 inches per cycle. The spacing from one station to the next may be about 24 inches. The time to transfer from one station to the next is preferably less than one second.

The side orientation station 1051*a/b*. 1320, 1400, 1500 should be located after the pick and place transfer conveyor 1030. It is the first in a series of orientation stations, as is shown in FIG. 10. The side orientation station, shown in more detail in FIG. 14, takes a randomly oriented, flat plate and orients it at about 90 degrees to the direction of travel of the sorting conveyor.

Generally, a plate 1540 falls down a chute 1410, 1510 to the side orientation station, where it is driven by a mechanical wiper 1420, 1520 sideways, orienting it the proper way. This process is shown in stages in FIGS. 15A-C. Sensors are positioned to detect when a plate is present in the side orientation station, and will also aid in determining when the sorting conveyor is clear for the placement of a plate on it. The side orientation station will typically be driven by a servomotor 1430, so that it can be driven forward and backward and so that current limits can be used to determine if there is a jam. The side orientation station should also needs to able to reject an inseparable double stack out the side of the car or other location. This may be done by running the conveyor backward. When rejecting plates an audible alarm will preferably sound prior to operation and rejection of plates, in order to alert bystanders of its operation. The plate rejection conveyor should be used to purge extra plates from the system in the event of a plate change-over.

A plate orientation detector 1052, 1330, 1600 determines if the plate is right side up, or upside down, and if it is oriented as slanting to the left or to the right. This station is shown in FIG. 10. Based on the orientations detected, downstream sorting equipment will be activated accordingly. In order to detect orientation accurately, the plate should be first positioned in a repeatable location on the sorting conveyor, underneath the sensing head 1620 as shown in FIG. 16. Once the plate is accurately positioned, a pivoting plate 1630 can detect the slant direction, and an inductive sensor array, or other suitable device, can detect if the plate is upside down, or right side up. Sensors may also be used to detect the presence of a plate before activating this station.

A right/left orientation station 1053, 1340, 1700*b* is provided and a preferred location shown in FIG. 10, and in more detail in FIGS. 17A-C. The right/left orientation station will typically squeeze 1720 the plate ends and if necessary spin the plate 1740 180 degrees as shown in FIGS. 17B-C. When finished the plate should be centered on the sorting conveyor and will have the cant set in the right direction. Sensors may be used to detect the presence of a plate before activating this station. This station is preferably reversible so that plates can be flipped to right or left depending on which side of the track is being worked on. In some embodiments, the station needs to be able to determine if a right/left orientation is need for upside down and right side up plates.

An up/down orientation station 1054, 1350, 1800 is the last station before placing the plates, and will, if necessary, flip the plate 1840 so that it is right side up. The station is shown in FIGS. 10 and 18A-B. This station is preferably adjustable to accommodate the different lengths of plates. Sensors may be used to detect the presence of a plate 1840 before activating this station. In some embodiments, if a plate is already right side up, this station will allow a plate to pass through it unhindered.

After the plates are oriented, the two sorting streams need to be combined into a single stream of oriented, ready-to-place, plates. It may be preferable for a conveying system to accumulate at least about 25 oriented plates before transitioning them to the plate placer 190, 2100.

The last stage of the system is a plate placement device 190, 2100. It may be positioned to trail the vehicle and have its own wheels and support system, an example of it is shown in FIGS. 1 and 21 A-B. Typically, all mechanisms within the plate placement device 190, 2100 will be either electrical or hydraulic. Ties 150, 2150 will be located using the opposite hand plate, and located using existing Automated Tie Location and Analyzing System 1900, 2040 (ATLAS) available from PLASSER AMERICA. The ATLAS system should to be capable of extending and retracting to avoid obstacles, and store when not in use as shown in FIG. 19.

In some embodiments, the placement device 2100 will place only one rail's tie plates during a run, but such a system will preferably be capable of being easily switched from one side to the other. The placement device 2100 will typically be configured to retract and store onto the body of the handling machine for travel, as shown in FIG. 20. Retraction and extending may be performed hydraulically and automatically as needed.

In some embodiments, a subsystem may be provided that is capable of counting laid plates.

The tie plate placement system 190, 2100 will preferably be able to skip laying plates in an interval. This is to facilitate the use of curve blocks. An example of this sequencing would be skipping a plate every fourth tie. The tie plated placement system may also, or alternatively, be capable of skipping IJ's, switches, crossings, and other features. In general, the tie plate placement system should place each plate 2200 accurately within an Adzer cut on the tie 2210, within ⅜" from the side of the tie, and within 1" of the inner cut as shown in FIG. 22. The Adzer cut will be 21" in length.

After exiting the orientation conveyors 2020, 2030, plates are combined with a left right conveyor 2000 before dropping to the placing sled conveyor 2010 (FIG. 20). An overview of the plate laying sled is provided in FIG. 20 and FIG. 21A-B. Referring to FIG. 21, the tie plate rolls down the sled conveyor 2110, enters the placing sled 2100, and stops at the plate stop 2120. Plate releasing arms 2130 hold the tie plate 2140 until it is at the correct position over the railroad tie 2150, and then release the tie plate 2140 at the proper position. When transitioning from work to travel mode the placing conveyor 2010 slides to the center of the machine 2050, 2170, and retracts underneath the existing conveyors as shown in FIG. 20.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description herein is for the purpose of describing particular embodiments only and is not intended to be limiting of the invention. As used in the description of the embodiments and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A tie plate distribution system comprising:

(a) a hopper machine comprising:

(i) a hopper platform, (ii) a crawler track located on a side of said hopper platform where tie plates are laid, said crawler track configured to ride over railroad ties, (iii) a rail gear located on a side of said hopper platform where tie plates are not laid, said rail gear configured to ride over a single rail, and (iv) a storage hopper for holding a quantity of tie plates;

(b) a handling machine comprising:

(i) a handling machine platform, (ii) a crawler track located on a side of said handling machine platform where tie plates are laid, said crawler track configured to ride over railroad ties, (iii) a rail gear located on a side of said handling machine platform where tie plates are not laid, said rail gear configured to ride over a single rail, (iv) a receiving hopper disposed on the handling machine platform, (v) a pick area configured to receive tie plates from the receiving hopper, (vi) a pick arm comprising an articulated arm and a magnet configured to pick a plate from the pick area, and (vii) a plurality of stations configured to arrange tie plates into an orientation for placement on railroad ties; and (c) a plate placer for depositing the tie plates on railroad ties as the system advances along a track.

2. The system of claim 1, wherein said crawler tracks are deployable and retractable.

3. The system of claim 1, wherein said crawler tracks are capable of independent steering.

4. The system of claim 1 further comprising a jack system fixed onto on one or both of said platforms, said jack system disposed to move said platform up and down to facilitate converting the platform from work to travel mode respectively.

5. The system of claim 4, wherein the jack system comprises a jack and an outrigger configured to allow in and out travel of the jack relative to the platform.

6. The system of claim 1 further comprising an excavator fixed to a pedestal fixed to the hopper platform and proximate to the receiving hopper.

7. The system of claim 6, wherein the excavator comprises an electromagnet positioned at a distal end of a stick of the excavator, said magnet disposed to pick up tie plates from the hopper of the hopper machine and transfer them to the receiving hopper of the handling machine.

8. The system of claim 1 wherein the hopper machine comprises a push broom disposed to clean the railroad ties.

9. The system of claim 1, wherein the hopper of the hopper machine comprises a divider to enable loading said hopper with at least two different types of tie plates.

10. The system of claim 1, wherein the hopper of the hopper machine comprises a grate positioned at a bottom of said hopper to filter debris.

11. The system of claim 1 comprising two pick areas and six pick arms, wherein three of said pick arms are disposed to pick tie plates from one of said two pick areas.

12. The system of claim 1, wherein the plurality of stations comprises a side orientation station, a left/right orientation station, and an up/down orientation station.

13. The system of claim 1, wherein the handling machine further comprises orientation conveyors that feed into a single conveyor that feeds into the plate placer.

14. The system of claim 1, wherein the plate placer comprises a support platform with wheels, an automated tie location and analyzing system (ATLAS), a conveyor, a plate stop, and plate releasing arms.

* * * * *